US005954028A

United States Patent [19]

Miyashita et al.

[11] Patent Number: 5,954,028

[45] Date of Patent: Sep. 21, 1999

[54] AIR-FUEL RATIO CONTROL SYSTEM FOR INTERNAL COMBUSTION ENGINES

[75] Inventors: Kotaro Miyashita; Hirofumi Mutoh; Yuichiro Tanabe, all of Wako, Japan

[73] Assignee: Honda Giken Kogyo Kabushiki Kaisha, Tokyo, Japan

[21] Appl. No.: 08/908,676

[22] Filed: Aug. 7, 1997

[30] Foreign Application Priority Data

| | | | |
|---|---|---|---|
| Aug. 8, 1996 | [JP] | Japan | 8-224604 |
| Aug. 8, 1996 | [JP] | Japan | 8-224605 |
| Aug. 8, 1996 | [JP] | Japan | 8-224606 |
| Aug. 8, 1996 | [JP] | Japan | 8-224609 |

[51] Int. Cl.[6] ..... F02M 7/00

[52] U.S. Cl. ..... 123/436

[58] Field of Search ..... 123/436, 435

[56] References Cited

U.S. PATENT DOCUMENTS

| | | | |
|---|---|---|---|
| 5,144,932 | 9/1992 | Miyashita et al. | 123/695 |
| 5,209,213 | 5/1993 | Miyashita et al. | 123/687 |
| 5,224,452 | 7/1993 | Tomizawa | 123/436 |
| 5,224,454 | 7/1993 | Miyashita et al. | 123/682 |
| 5,493,901 | 2/1996 | Kuroda et al. | 73/116 |
| 5,630,397 | 5/1997 | Shimizu et al. | 123/436 |

FOREIGN PATENT DOCUMENTS

| | | |
|---|---|---|
| 58-214649 | 12/1983 | Japan . |
| 58-217732 | 12/1983 | Japan . |
| 60-128947 | 7/1985 | Japan . |
| 62-99647 | 5/1987 | Japan . |
| 62-189336 | 8/1987 | Japan . |
| 63-67643 | 5/1988 | Japan . |
| 6-10739 | 1/1994 | Japan . |
| 6-23553 | 3/1994 | Japan . |
| 7-166980 | 6/1995 | Japan . |
| 7-310570 | 11/1995 | Japan . |
| 8-4567 | 1/1996 | Japan . |
| 8-4568 | 1/1996 | Japan . |
| 8-177549 | 7/1996 | Japan . |
| 8-177574 | 7/1996 | Japan . |

*Primary Examiner*—Willis R. Wolfe
*Assistant Examiner*—Arnold Castro
*Attorney, Agent, or Firm*—Nikaido Marmelstein Murray & Oram LLP

[57] ABSTRACT

An air-fuel ratio control system for an internal combustion engine includes an air-fuel ratio sensor arranged in an exhaust system thereof for generating an output substantially proportional in value to an air-fuel ratio of exhaust gases emitted from the engine. An amount of variation in combustion of the engine is detected. A desired air-fuel ratio of a mixture supplied to the engine is set to a value leaner than a stoichiometric air-fuel ratio based on the amount of variation in combustion of the engine, when the engine is in a predetermined operating condition. Feedback control of an air-fuel ratio of the mixture to the desired air-fuel ratio is carried out in response to the output from the air-fuel ratio sensor. The desired air-fuel ratio is set to a richer value than an immediately preceding value thereof when the amount of variation in combustion of the engine detected is large and to a leaner value than the immediately preceding value thereof when the amount of variation in combustion of the engine is small. A value of the desired air-fuel ratio set is learned as an actual lean limit of the air-fuel ratio for stable combustion of the engine. A rate of change of the desired air-fuel ratio is adjusted based on the learned value of the desired air-fuel ratio.

14 Claims, 19 Drawing Sheets

THREE-WAY CATALYST
14
13
LAF
15
INTERNAL COMBUSTION ENGINE
1
CYL
22
TDC
12
CRK
11
TW
10
TA
9
PBA
8
θTH
4
7
2
3
3'
6
FUEL INJECTION VALVE
PA
16
VSP
17
CSW
18
GP
19
5a
5b
5c
5d
INPUT CIRCUIT
CPU
MEMORY DEVICE
OUTPUT CIRCUIT
ECU
51
5
ELECTROMAGNETIC VALVE
21
POIL
20

CALCULATION OF KBS
CALCULATION OF KBSM
S841
CALCULATION OF KWOT
S842
S843
FWOT=1 ?
YES
NO
S844
KWOT≧KBSM ?
YES
NO
S847
KBSM<KBSM0 ?
NO
YES
S848
tmKCM←tmKCMHLD
S851
LARGELY STEPPED ON ?
NO
YES
S852
DPB>DPBKCR ?
YES
NO
S853
tmKCM←tmKCMHLD
S854
tmKCM=0 ?
NO
YES
S845
tmKCM←tmKCMHLD
KBS←KWOT
S846
S858
KBS←KBSM0
S856
KBS←KBSM
RETURN

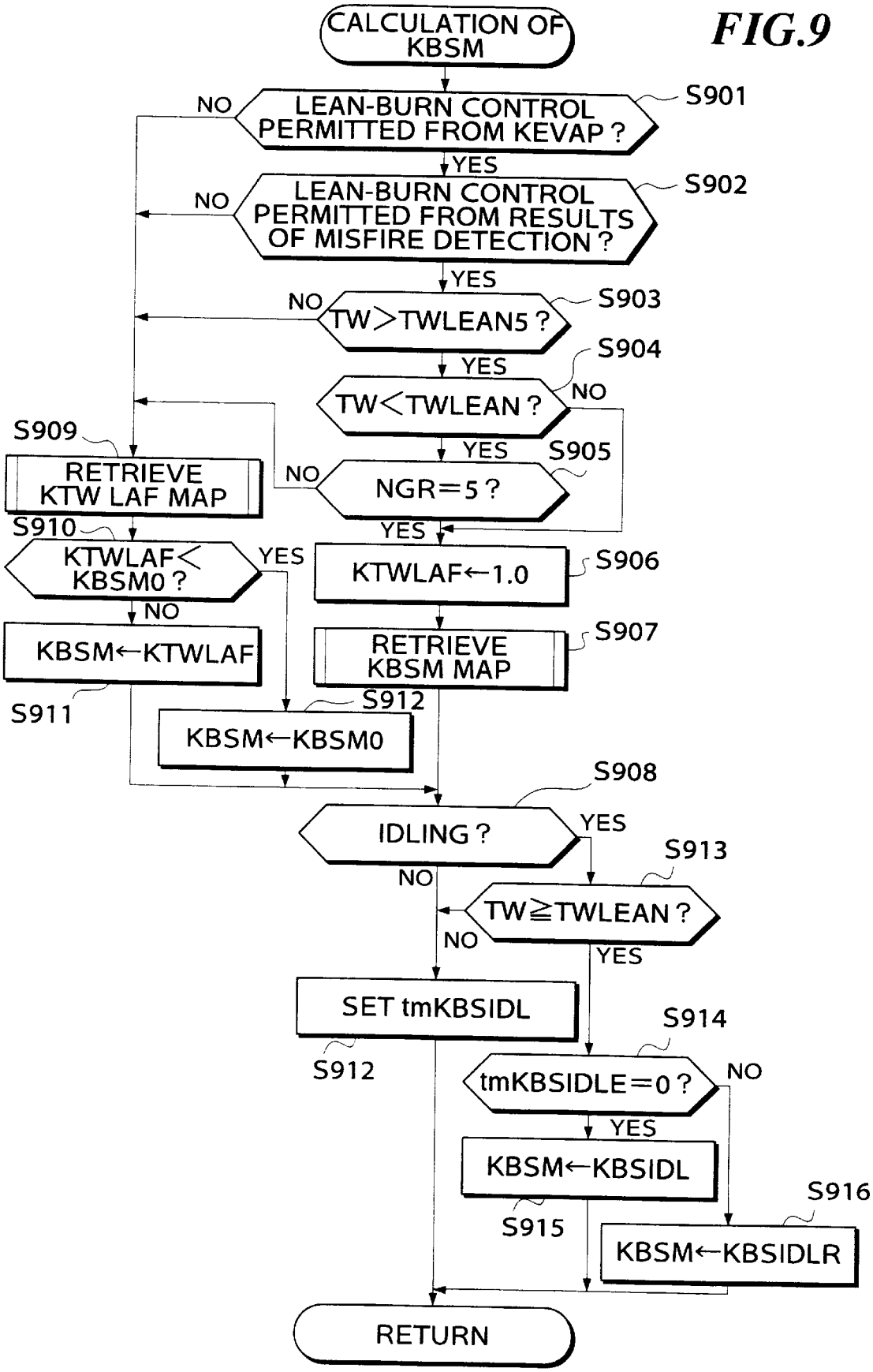
FIG.9
CALCULATION OF KBSM
LEAN-BURN CONTROL PERMITTED FROM KEVAP ?
S901
NO
YES
LEAN-BURN CONTROL PERMITTED FROM RESULTS OF MISFIRE DETECTION ?
S902
NO
YES
TW>TWLEAN5 ?
S903
NO
YES
TW<TWLEAN ?
S904
NO
YES
NGR=5 ?
S905
NO
YES
RETRIEVE KTW LAF MAP
S909
KTWLAF< KBSM0 ?
S910
YES
NO
KTWLAF←1.0
S906
KBSM←KTWLAF
S911
RETRIEVE KBSM MAP
S907
KBSM←KBSM0
S912
IDLING ?
S908
YES
NO
TW≧TWLEAN ?
S913
NO
YES
SET tmKBSIDL
S912
tmKBSIDLE=0 ?
S914
NO
YES
KBSM←KBSIDL
S915
KBSM←KBSIDLR
S916
RETURN

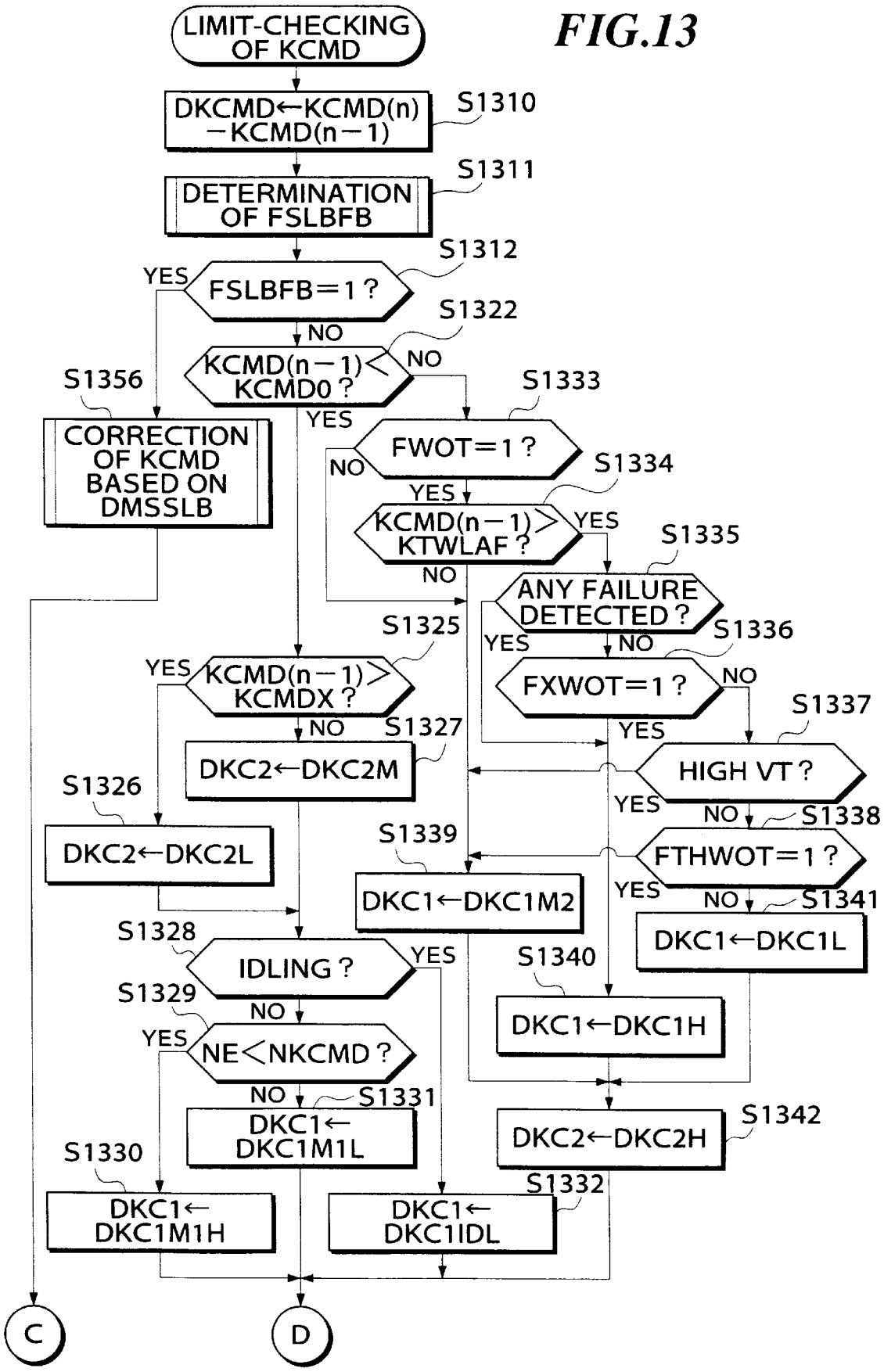
FIG.13
LIMIT-CHECKING OF KCMD
DKCMD←KCMD(n) −KCMD(n−1)
S1310
DETERMINATION OF FSLBFB
S1311
FSLBFB=1 ?
S1312
YES
NO
KCMD(n−1)< KCMD0 ?
S1322
NO
YES
S1356
CORRECTION OF KCMD BASED ON DMSSLB
S1333
FWOT=1 ?
NO
YES
S1334
KCMD(n−1)> KTWLAF ?
YES
NO
S1335
ANY FAILURE DETECTED ?
YES
NO
S1336
FXWOT=1 ?
NO
YES
S1337
HIGH VT ?
YES
NO
S1338
FTHWOT=1 ?
YES
NO
S1341
DKC1←DKC1L
S1325
KCMD(n−1)> KCMDX ?
YES
NO
S1327
DKC2←DKC2M
S1326
DKC2←DKC2L
S1339
DKC1←DKC1M2
S1340
DKC1←DKC1H
S1328
IDLING ?
YES
S1329
NO
NE<NKCMD ?
YES
NO
S1331
DKC1← DKC1M1L
S1342
DKC2←DKC2H
S1330
DKC1← DKC1M1H
S1332
DKC1← DKC1IDL
C
D

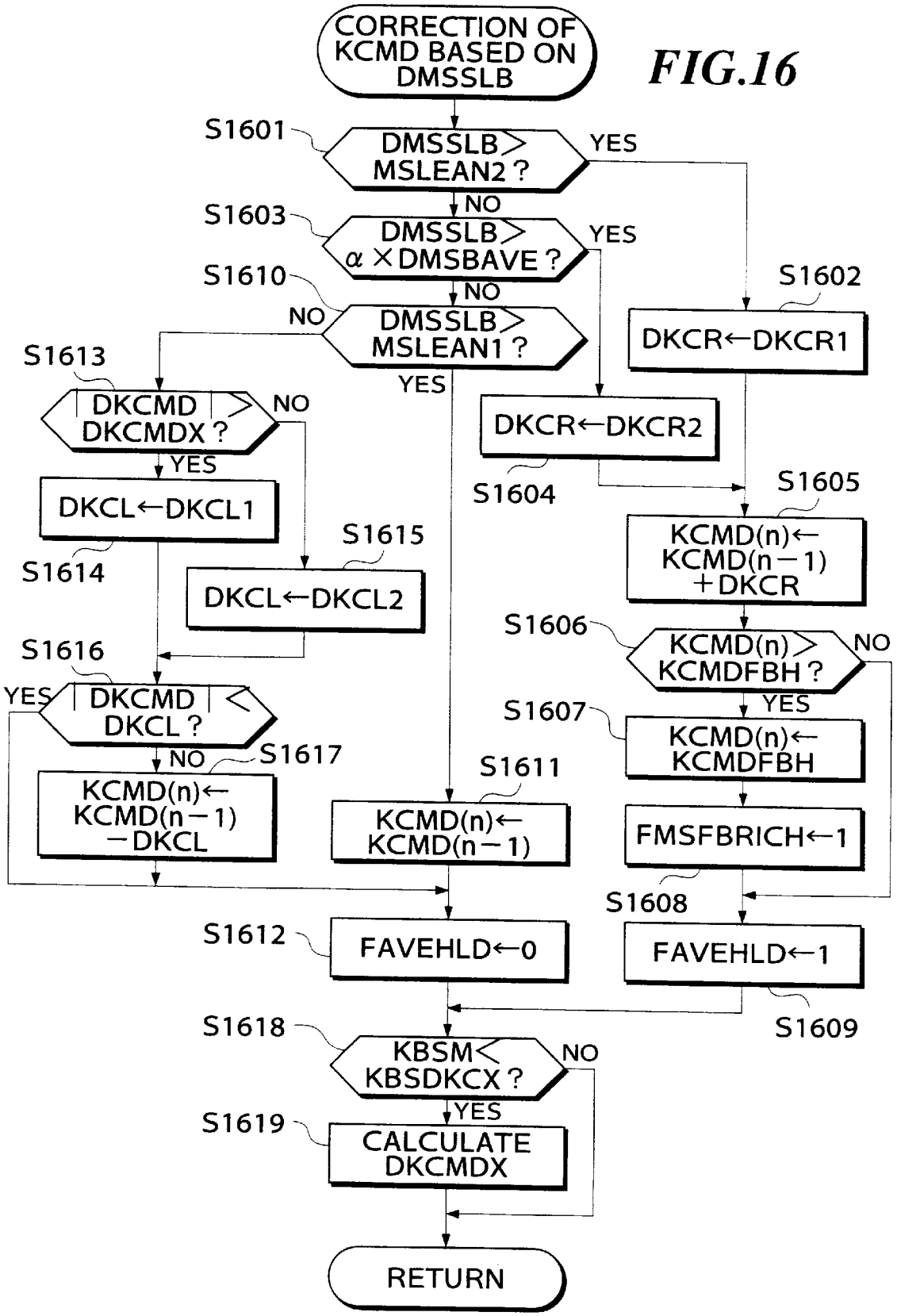
CORRECTION OF KCMD BASED ON DMSSLB
FIG.16
S1601
DMSSLB > MSLEAN2 ?
YES
NO
S1603
DMSSLB > α × DMSBAVE ?
YES
NO
S1610
DMSSLB > MSLEAN1 ?
NO
YES
S1602
DKCR←DKCR1
S1613
| DKCMD | > DKCMDX ?
NO
YES
DKCL←DKCL1
S1614
S1615
DKCL←DKCL2
DKCR←DKCR2
S1604
S1605
KCMD(n)← KCMD(n−1) +DKCR
S1606
KCMD(n) > KCMDFBH ?
NO
YES
S1607
KCMD(n)← KCMDFBH
FMSFBRICH←1
S1608
FAVEHLD←1
S1609
S1616
YES
| DKCMD | < DKCL ?
NO
S1617
KCMD(n)← KCMD(n−1) −DKCL
S1611
KCMD(n)← KCMD(n−1)
S1612
FAVEHLD←0
S1618
KBSM < KBSDKCX ?
NO
YES
S1619
CALCULATE DKCMDX
RETURN

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which is adapted to change a desired air-fuel ratio to which the air-fuel ratio of a mixture supplied to the engine is controlled, depending upon an amount of variation in the rotational speed of the engine during execution of so-called lean-burn control.

2. Prior Art

An air-fuel ratio control system for internal combustion engines is conventionally known which performs so-called lean-burn control of controlling the air-fuel ratio of a mixture supplied to the engine to a value leaner than a stoichiometric air-fuel ratio when the engine is in a steady operating condition or in a gently accelerating condition.

The conventional air-fuel ratio control system of this kind includes one proposed e.g. by Japanese Patent Publication (Kokoku) No. 6-23553, according to which when predetermined conditions (hereinafter referred to as "the lean-burn control-permitting conditions") under which lean-burn control is permitted are fulfilled, the air-fuel ratio of a mixture supplied to the engine is changed to a predetermined desired lean air-fuel ratio, by progressively changing the desired air-fuel ratio of the mixture toward a leaner side by a predetermined amount, and then an amount of variation in the rotational speed (rotational speed variation amount) of the engine is detected. The detected rotational speed variation amount is compared with a predetermined desired lean value, and when the former is larger than the latter, the air-fuel ratio is controlled to a slightly richer value than the predetermined desired lean air-fuel ratio. That is, a degree of unstability of the engine operating condition is detected during execution of the lean-burn control, and when the detected degree of unstability is higher than a predetermined value set for preventing a misfire of the engine, the air-fuel ratio is enriched such that the degree of unstability becomes lower than the predetermined value.

In the proposed air-fuel ratio control system, however, the air-fuel ratio is controlled by the use of a correction amount which enriches the air-fuel ratio according to the rotational speed variation amount during execution of the lean-burn control, resulting in an undesirable increase in the amount of generation of NOx from the engine.

FIG. 19A shows an example of changes in the air-fuel ratio obtained by the lean-burn control of the conventional air-fuel ratio control system. As shown in FIG. 19A, the air-fuel ratio of a mixture supplied to the engine is changed in a leaning direction toward a predetermined desired lean air-fuel ratio. If the controlled air-fuel ratio is made leaner than an actual lean limit for stable engine combustion, the combustion of the engine becomes unstable as indicated by (1). Further, according to the conventional system, the correction amount of the air-fuel ratio applied at the actual lean limit for stable engine combustion is reset upon termination of the lean-burn control. Therefore, when the lean-burn control is subsequently started again after the air-fuel ratio has been once controlled to the stoichiometric air-fuel ratio due to a change in the operating condition of the engine (as indicated by (3)), the air-fuel ratio of the mixture is leaned to the predetermined desired lean value, which causes unstable combustion of the engine again (indicated by (4)). Further, when the engine combustion becomes unstable as indicated by (1), the air-fuel ratio is controlled to a richer value until the combustion state of the engine is stabilized. However, the enriched air-fuel ratio is still employed as indicated by (2) in FIG. 19A even after the combustion state of the engine has been stabilized, which results in generation of NOx. Further, in this case, even if the actual lean limit for stable engine combustion is shifted in a leaning direction as indicated by (2), the controlled air-fuel ratio is held at the enriched value, which hinders improvement of the fuel economy.

Further, in the conventional air-fuel ratio control system, the correction amount which enriches the desired air-fuel ratio according to the rotational speed variation amount during execution of the lean-burn control has no upper limit set therefor, so that when the lean limit for stable engine combustion becomes much richer due to a change in the environmental condition or the operating condition of the engine, the desired air-fuel ratio is set to an abnormally enriched value. As a result, the fuel economy is not improved to a satisfactory degree, and at the same time NOx is generated in abnormally increased amounts.

Further, according to the conventional air-fuel control system, the desired air-fuel ratio for the air-fuel ratio feedback control is not directly changed from the stoichiometric air-fuel ratio to the desired lean air-fuel ratio, but the desired air-fuel ratio is progressively changed to the desired lean air-fuel ratio, so as to prevent a shock caused by a drastic change in the air-fuel ratio.

However, in the course of the progressive change of the desired air-fuel ratio from the stoichiometric air-fuel ratio to the desired lean air-fuel ratio, a change in the engine torque is caused by the change in the air-fuel ratio, and this change in the engine torque can be erroneously judged to have been caused by an unstable combustion of the engine though the engine is in a stable combustion. As a result, the desired air-fuel ratio is corrected in an enriching direction, which hinders the desired air-fuel ratio from being smoothly changed to the leaning desired lean air-fuel ratio, so that a time period during which the air-fuel ratio assumes such a value as will cause a larger amount of generation of NOx becomes longer.

Still further, in the conventional air-fuel ratio control system, the air-fuel ratio is corrected in an enriching direction when the detected rotational speed variation amount exceeds a predetermined fixed threshold value. However, individual engines actually employed have respective peculiar combustion variation characteristics ascribable to manufacturing tolerances of the engines, etc. Therefore, if variations in the combustion state of the engines are each determined using the same threshold value and the desired lean air-fuel ratio is corrected based on results of the determination, the air-fuel ratio of a mixture supplied to the engine can deviate from an optimal value at which the driveability and fuel economy of the engine can be balanced.

SUMMARY OF THE INVENTION

It is a first object of the invention to provide an air-fuel ratio control system for an internal combustion engine, which is capable of achieving stable lean-burn control and at the same time setting a correction amount for leaning the air-fuel ratio when the engine combustion is stable, to thereby minimize the amount of generation of NOx.

It is a second object of the invention to provide an air-fuel ratio control system for an internal combustion engine, which is capable of limiting conditions for carrying out lean-burn control when a lean limit of the air-fuel ratio for stable engine combustion is shifted to a much richer value than a normal value due to a change in the environmental condition or the operating condition of the engine during execution of lean-burn feedback control, to thereby prevent abnormal generation of NOx.

It is a third object of the invention to provide an air-fuel ratio control system for an internal combustion engine, which is capable of smoothly shifting a desired air-fuel ratio to which the air-fuel ratio of a mixture supplied to the engine is controlled to a desired lean air-fuel ratio at the start of the lean-burn feedback control, thereby making it possible to feedback-control the air-fuel ratio to an optimal value at which the driveability and fuel economy of the engine are balanced.

It is a fourth object of the invention to provide an air-fuel ratio control system for an internal combustion engine, which is capable of determining a combustion variation limit according to combustion variation characteristics peculiar to individual engines employed, to thereby carry out lean-burn feedback control to make the air-fuel ratio equal to an optimal value at which the driveability and fuel economy of the engine are balanced.

To attain the first object, according to a first aspect of the invention, there is provided an air-fuel ratio control system for an internal combustion engine having an exhaust system, the air-fuel ratio control system including air-fuel ratio-detecting means arranged in the exhaust system for generating an output substantially proportional in value to an air-fuel ratio of exhaust gases emitted from the engine, combustion variation-detecting means for detecting an amount of variation in combustion of the engine, desired air-fuel ratio-setting means for setting a desired air-fuel ratio of a mixture supplied to the engine to a value leaner than a stoichiometric air-fuel ratio based on the amount of variation in combustion of the engine, when the engine is in a predetermined operating condition, and feedback control means for carrying out feedback control of an air-fuel ratio of the mixture to the desired air-fuel ratio in response to the output from the air-fuel ratio-detecting means.

The air-fuel ratio control system according to the first aspect of the invention is characterized in that the desired air-fuel ratio-setting means comprises:

combustion variation-responsive means for setting the desired air-fuel ratio to a richer value than an immediately preceding value thereof when the amount of variation in combustion of the engine detected by the combustion variation-detecting means is large, and setting the desired air-fuel to a leaner value than the immediately preceding value thereof, when the amount of variation in combustion of the engine detected by the combustion variation-detecting means is small;

learning means for learning a value of the desired air-fuel ratio set by the combustion variation-responsive means as an actual lean limit of the air-fuel ratio for stable combustion of the engine; and desired air-fuel ratio-adjusting means for adjusting a rate of change of the desired air-fuel ratio based on the learned value of the desired air-fuel ratio obtained by the learning means.

Preferably, the combustion variation-responsive means changes the desired air-fuel ratio to the richer value than the immediately preceding value when the amount of variation in combustion of the engine is larger than a first predetermined value, and changes the desired air-fuel ratio to the leaner value than the immediately preceding value when the amount of variation in combustion of the engine is smaller than a second predetermined value smaller than the first predetermined value.

More preferably, the desired air-fuel ratio-adjusting means sets the rate of change of the desired air-fuel ratio to a lower rate when the desired air-fuel ratio is leaner than the learned value of the desired air-fuel ratio than when the desired air-fuel ratio is richer than the learned value of the desired air-fuel ratio.

Preferably, the air-fuel ratio control system includes storing means for permanently storing the learned value of the desired air-fuel ratio obtained by the learning means.

To attain the second object, according to a second aspect of the invention, there is provided an air-fuel ratio control system for an internal combustion engine having an exhaust system, the air-fuel ratio control system including air-fuel ratio-detecting means arranged in the exhaust system for generating an output substantially proportional in value to an air-fuel ratio of exhaust gases emitted from the engine, combustion variation-detecting means for detecting an amount of variation in combustion of the engine, desired air-fuel ratio-setting means for setting a desired air-fuel ratio of a mixture supplied to the engine to a value leaner than a stoichiometric air-fuel ratio based on the amount of variation in combustion of the engine, when the engine is in a predetermined operating condition, and feedback control means for carrying out feedback control of an air-fuel ratio of the mixture to the desired air-fuel ratio in response to the output from the air-fuel ratio-detecting means.

The air-fuel ratio control system according to the second aspect of the invention is characterized in that:

the desired air-fuel ratio-setting means comprises combustion variation-responsive means for setting the desired air-fuel ratio to a richer value than an immediately preceding value thereof when the amount of variation in combustion of the engine detected by the combustion variation-detecting means is large; and the air-fuel ratio control system comprises lean-burn condition-limiting means for permitting the desired air-fuel ratio-setting means to set the desired air-fuel ratio to the value leaner than the stoichiometric air-fuel ratio only when the engine is in an operating condition more limited than the predetermined operating condition, after the richer value of the desired air-fuel ratio than the immediately preceding value set by the combustion variation-responsive means has reached a predetermined value.

Preferably, the engine is installed on an automotive vehicle having a transmission, the air-fuel ratio control system including gear position-determining means for determining a gear position of the transmission which is selected, the lean-burn condition-limiting means permitting the desired air-fuel ratio-setting means to set the desired air-fuel ratio to the value leaner than the stoichiometric air-fuel ratio only when the gear position of the transmission determined by the gear position-determining means is within a gear position range limited to higher speed positions than a gear position range set for the predetermined operating condition of the engine, after the richer value of the desired air-fuel ratio than the immediately preceding value set by the combustion variation-responsive means has reached the predetermined value.

Preferably, the air-fuel ratio control system includes rotational speed-detecting means for detecting rotational speed of the engine, and the lean-burn condition-limiting means permits the desired air-fuel ratio-setting means to set the desired air-fuel ratio to the value leaner than the stoichiometric air-fuel ratio only when the rotational speed of the engine detected by the rotational speed-detecting means is within a rotational speed range limited to higher rotational speeds than a rotational speed range set for the predetermined operating condition of the engine, after the richer value of the desired air-fuel ratio than the immediately preceding value set by the combustion variation-responsive means has reached the predetermined value.

To attain the second object, according to a third aspect of the invention, there is provided an air-fuel ratio control system for an internal combustion engine having an exhaust system, the air-fuel ratio control system including air-fuel ratio-detecting means arranged in the exhaust system for generating an output substantially proportional in value to an air-fuel ratio of exhaust gases emitted from the engine, combustion variation-detecting means for detecting an amount of variation in combustion of the engine, desired air-fuel ratio-setting means for setting a desired air-fuel ratio of a mixture supplied to the engine to a value leaner than a stoichiometric air-fuel ratio based on the amount of variation in combustion of the engine, when the engine is in a predetermined operating condition, and feedback control means for carrying out feedback control of an air-fuel ratio of the mixture to the desired air-fuel ratio in response to the output from the air-fuel ratio-detecting means.

The air-fuel ratio control system according to third aspect of the invention is characterized in that:

the desired air-fuel ratio-setting means comprises combustion variation-responsive means for setting the desired air-fuel ratio to a richer value than an immediately preceding value thereof when the amount of variation in combustion of the engine detected by the combustion variation-detecting means is large; and the air-fuel ratio control system comprises limiting means for limiting the desired air-fuel ratio to a predetermined value when the richer value of the desired air-fuel ratio than the immediately preceding value set by the combustion variation-responsive means has reached the predetermined value.

To attain the third object, according to a fourth aspect of the invention, there is provided an air-fuel ratio control system for an internal combustion engine having an exhaust system, the air-fuel ratio control system including air-fuel ratio-detecting means arranged in the exhaust system for generating an output substantially proportional in value to an air-fuel ratio of exhaust gases emitted from the engine, combustion variation-detecting means for detecting an amount of variation in combustion of the engine, desired air-fuel ratio-setting means for setting a desired air-fuel ratio of a mixture supplied to the engine to a value leaner than a stoichiometric air-fuel ratio, when the engine is in a predetermined operating condition, and feedback control means for carrying out feedback control of an air-fuel ratio of the mixture to the desired air-fuel ratio in response to the output from the air-fuel ratio-detecting means.

The air-fuel ratio control system according to the fourth aspect of the invention is characterized by comprising:

combustion variation-responsive means for setting the desired air-fuel ratio to a richer value than an immediately preceding value thereof when the amount of variation in combustion of the engine detected by the combustion variation-detecting means is large;

progressively leaning means for progressively changing the desired air-fuel ratio to the value of the desired air-fuel ratio leaner than the stoichiometric air fuel ratio when the desired air-fuel ratio-setting means set the desired air-fuel ratio to the value leaner than the stoichiometric air-fuel ratio; and inhibiting means for inhibiting the combustion variation-responsive means from setting the desired air-fuel ratio to the value richer than the immediately preceding value thereof based on an output from the combustion variation-detecting means until a value to which the desired air-fuel ratio is changed by the progressively leaning means has becomes leaner than a predetermined lean value leaner than the stoichiometric air-fuel ratio.

Preferably, the inhibiting means determines that the value to which the desired air-fuel ratio is changed by the progressively leaning means has become leaner than the predetermined lean value leaner than the stoichiometric air-fuel ratio when a difference between the value of the desired air-fuel ratio set by the desired air-fuel ratio-setting means when the engine is in the predetermined operating condition and the value to which the desired air-fuel ratio is changed by the progressively leaning means becomes smaller than a predetermined amount.

More preferably, the predetermined amount is larger than a difference between the value of the desired air-fuel ratio set by the desired air-fuel ratio-setting means and a value of the air-fuel ratio corresponding to an actual lean limit of the air-fuel ratio for stable combustion of the engine.

To attain the fourth object, according to a fifth aspect of the invention, there is provided an air-fuel ratio control system for an internal combustion engine having an exhaust system, the air-fuel ratio control system including air-fuel ratio-detecting means arranged in the exhaust system for generating an output substantially proportional in value to an air-fuel ratio of exhaust gases emitted from the engine, combustion variation-detecting means for detecting an amount of variation in combustion of the engine, desired air-fuel ratio-setting means for setting a desired air-fuel ratio of a mixture supplied to the engine to a value leaner than a stoichiometric air-fuel ratio based on the amount of variation in combustion of the engine, when the engine is in a predetermined operating condition, and feedback control means for carrying out feedback control of an air-fuel ratio of the mixture to the desired air-fuel ratio in response to the output from the air-fuel ratio-detecting means.

The air-fuel ratio control system according to the fifth aspect of the invention is characterized by comprising:

combustion variation-averaging means for averaging the amount of variation in combustion of the engine detected by the combustion variation-detecting means;

unstable combustion-determining threshold value-setting means for setting a threshold value for determining unstable combustion of the engine, based on an averaged value of the amount of variation in combustion of the engine obtained by the combustion variation-averaging means; and combustion variation-responsive means for setting the desired air-fuel ratio to a richer value than an immediately preceding value thereof when the amount of variation in combustion of the engine detected by the combustion variation-detecting means is larger than the threshold value set by the unstable combustion-determining threshold value-setting means.

Preferably, the unstable combustion-determining threshold value-setting means sets the threshold value for determining the unstable combustion of the engine by multiplying the averaged value of the amount of variation in combustion of the engine by a coefficient dependent on operating conditions of the engine.

Preferably, the combustion variation-responsive means adjusts the desired air-fuel ratio to the value richer than the immediately preceding value by the desired air-fuel ratio-setting means by the use of a first enriching adjusting amount when the amount of variation in combustion detected by the combustion variation-detecting means is larger than a predetermined value larger than the threshold value set by the unstable combustion-determining threshold value-setting means, and by the use of a second enriching adjusting amount which is smaller than the first enriching adjusting amount when the amount of variation in combustion of the engine detected by the combustion variation-detecting means is smaller than the predetermined value and at the same time larger than the threshold value.

The above and other objects, features, and advantages of the invention will become more apparent from the following detailed description taken in conjunction with the accompanying drawings.

BRIEF DESCRIPTION OF THE DRAWINGS

FIGS. 2A and 2B are flowcharts showing routines detecting a rotational speed variation amount DMSSLB of the engine, in which:

FIG. 2A is a flowchart showing a routine for carrying out a CRK processing; and FIG. 2B is a flowchart showing a routine for carrying out a #STG processing;

FIG. 9 is a flowchart showing a subroutine for calculating a KBS-setting basic value KBSM of the basic value KBS, which is executed at a step S841 in FIG. 8;

FIG. 13 is a flowchart showing a subroutine for carrying out limit-checking of the KCMD value, which is executed at a step S638 in FIG. 7;

FIG. 16 is a flowchart showing a subroutine for correcting the KCMD value according to the rotational speed variation amount DMSSLB, which is executed at a step S1356 in FIG. 13;

FIG. 19A and 19B are diagrams useful in explaining the difference between lean-burn control executed by a conventional air-fuel ratio control system for internal combustion engines and the lean-burn control executed by the air-fuel ratio control system according to the present invention, in which:

FIG. 19A shows changes in the air-fuel ratio obtained during execution of the lean-burn control by the conventional air-fuel ratio control system; and FIG. 19B shows changes in the air-fuel ratio obtained during execution of the lean-burn control by the air-fuel ratio control system according to the invention.

DETAILED DESCRIPTION

The invention will now be described in detail with reference to the drawings showing an embodiment thereof.

Figure 1:
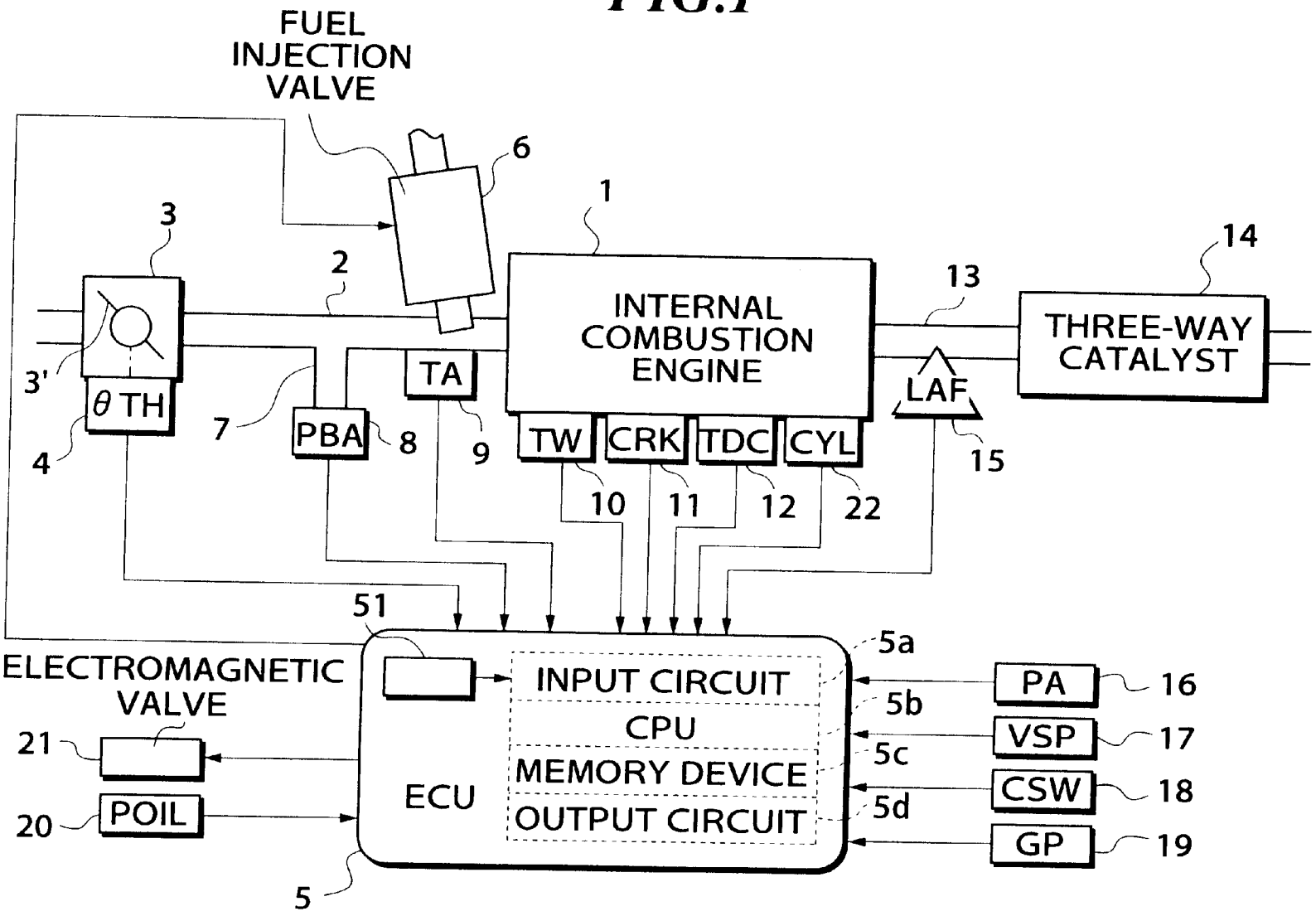
FIG. 1 is a block diagram showing the whole arrangement of an internal combustion engine incorporating an air-fuel ratio control system according to an embodiment of the invention.

Referring first to FIG. 1, there is shown the whole arrangement of an internal combustion engine (hereinafter simply referred to as "the engine") incorporating a control system therefor according to an embodiment of the invention. In the figure, reference numeral 1 designates a SOHC straight type four-cylinder engine, each cylinder being provided with a pair of an intake valve and an exhaust valve, neither of which is shown. This engine 1 is constructed such that it is capable of changing operating characteristics of the intake valves and exhaust valves, i.e. the valve opening period and the valve lift (generically referred to hereinafter as "the valve timing"), between a high-speed valve timing suitable for operation of the engine in a high engine speed region, a medium-speed valve timing suitable for operation of the engine in a medium engine speed region, and a low-speed valve timing suitable for operation of the engine in a low engine speed region.

The engine 1 has an intake pipe 2 across which is arranged a throttle body 3 accommodating a throttle valve 3' therein. A throttle valve opening (θTH) sensor 4 is connected to the throttle valve 3', for generating an electric signal indicative of the sensed throttle valve opening (θTH) and supplying the same to an electronic control unit (hereinafter referred to as "the ECU 5").

Fuel injection valves 6, only one of which is shown, are inserted into the intake pipe 2 at locations intermediate between the throttle valve 3' and the cylinder block of the engine 1 and slightly upstream of respective intake valves, not shown. The fuel injection valves 6 are connected to a fuel pump, not shown, and electrically connected to the ECU 5 to have their valve opening periods controlled by signals therefrom.

Further, an electromagnetic valve 21 is connected to an output side of the ECU 5, for making changeover of the valve timing. The electromagnetic valve 21 has opening and closing operations thereof controlled by the ECU 5, to select high, medium, or low hydraulic pressure applied to a valve timing changeover device, not shown. Responsive to this high, medium, or low hydraulic pressure selected, the valve timing changeover device operates to change the valve timing to the high-speed valve timing, the medium-speed valve timing, or the low-speed valve timing. The hydraulic pressure applied to the valve timing changeover device is detected by a hydraulic pressure (oil pressure) (POIL) sensor 20 which supplies a signal indicative of the sensed hydraulic pressure to the ECU 5.

On the other hand, an intake pipe absolute pressure (PBA) sensor 8 is provided in communication with the interior of the intake pipe 2 via a conduit 7 opening into the intake pipe 2 at a location immediately downstream of the throttle valve 3, for supplying an electric signal indicative of the sensed absolute pressure PBA within the intake pipe 2 to the ECU 5. An intake air temperature (TA) sensor 9 is inserted into the intake pipe 2 at a location downstream of the PBA sensor 8, for supplying an electric signal indicative of the sensed intake air temperature TA to the ECU 5.

An engine coolant temperature (TW) sensor 10, which may be formed of a thermistor or the like, is mounted in the cylinder block of the engine 1, for supplying an electric signal indicative of the sensed engine coolant temperature TW to the ECU 5. A crank angle (CRK) sensor 11, a TDC sensor 12, and a cylinder-discriminating (CYL) sensor 22 are arranged in facing relation to a camshaft or a crankshaft, neither of which is shown, of the engine 1 at respective predetermined locations. The TDC sensor 12 generates a pulse (hereinafter referred to as "the TDC signal pulse") at a predetermined crank angle position of each cylinder a predetermined angle before a TDC position corresponding to the start of the intake stroke of the cylinder whenever the crankshaft rotates through 180 degrees, and delivers the TDC signal pulse to the ECU 5. The CYL sensor 22 generates a pulse at a predetermined crank angle position of a particular cylinder of the engine, and delivers the CYL signal pulse to the ECU 5. The CRK sensor 11 generates a pulse (hereinafter referred to as "the CRK signal pulse") at each of predetermined crank angle positions whenever the crankshaft rotates through a predetermined angle (e.g. 30 degrees) smaller than the rotational angle of generation of the TDC signal pulse and delivers the CRK signal pulse to the ECU 5.

A three-way catalyst 14 is arranged within an exhaust pipe 13 connected to the cylinder block of the engine 1, for purifying noxious components such as HC, CO, and NOx. An oxygen concentration sensor (hereinafter referred to as "the LAF sensor") 15 as air-fuel ratio-detecting means is arranged within the exhaust pipe 13 at a location upstream of the three-way catalyst 14, for supplying the ECU 5 with an electric signal almost proportional in value to the concentration of oxygen in exhaust gases emitted from the engine 1.

Further connected to the ECU 5 are an atmospheric pressure (PA) sensor 16, a vehicle speed (VSP) sensor 17 for detecting the traveling speed of a vehicle, not shown, on which the engine is installed, a clutch sensor 18 for detecting engagement/disengagement of a clutch, not shown, of the vehicle, and a gear position sensor 19 for detecting the gear shift position of an automatic transmission of the engine 1, for supplying respective signals indicative of the detected parameters to the ECU 5.

The ECU 5 is comprised of an input circuit 5a having the functions of shaping the waveforms of input signals from various sensors including those mentioned above, shifting the voltage levels of sensor output signals to a predetermined level, converting analog signals from analog-output sensors to digital signals, and so forth, a central processing unit (hereinafter referred to as "the CPU") 5*b*, a memory device 5*c* storing various operational programs which are executed by the CPU 5*b*, and for storing results of calculations therefrom, etc., and an output circuit 5*d* which outputs driving signals to the fuel injection valves 6, the electromagnetic valve 21, etc.

Further, the ECU 5 has a voltage regulator 51 incorporated therein, and analog-output voltage from the voltage regulator 51 is converted to a digital signal to be delivered to the CPU 5*b*. The voltage regulator 51 is comprised of three variable voltage supply circuits each including a voltage divider formed of resistors connected to a constant voltage supply circuit, not shown. The three variable voltage supply circuits can be manually adjusted independently of each other. First to third mass production correction coefficients KCMPRO 1 to 3, which will be used in calculation of a desired air-fuel ratio KCMD at steps in FIG. 7 described hereinafter, are set by the output voltage of the variable voltage supply circuits.

The voltage regulator 51 is adjusted e.g. during assembly when the control system of FIG. 1 is incorporated into the engine 1 or during a regular maintenance operation so as to accommodate variations in characteristics between individual engines employed, as well as changes in the characteristics due to aging of the engine.

The CPU 5*b* operates in response to the above-mentioned signals from the sensors to determine various operating conditions in which the engine 1 is operating, such as an air-fuel ratio feedback control region in which the air-fuel ratio of a mixture supplied to the engine 1 is controlled in response to the detected oxygen concentration in the exhaust gases, and open-loop control regions other than the air-fuel ratio feedback control region, and calculates, based upon the determined operating conditions, the valve opening period or fuel injection period TOUT over which the fuel injection valves 6 are to be opened, by the use of the following equation (1), in synchronism with inputting of TDC signal pulses to the ECU 5:

$$TOUT=Ti\times KCMD\times KLAF\times KEVAP\times K1+K2 \quad (1)$$

where Ti represents a basic fuel injection amount, more specifically a basic fuel injection period which is determined in accordance with the engine rotational speed NE and the intake pipe absolute pressure PBA. A Ti map for determining the Ti value is stored in the memory device 5*c*.

KCMD represents the desired air-fuel ratio coefficient. The equation (1) shows that the fuel injection period TOUT increases as the desired air-fuel ratio coefficient KCMD increases, i.e. that the desired air-fuel ratio coefficient KCMD is directly proportional to the reciprocal of the air-fuel ratio A/F.

KLAF represents an air-fuel ratio correction coefficient. The air-fuel ratio correction coefficient KLAF is set in response to the output from the LAF sensor 15, during execution of the air-fuel ratio feedback control, such that the air-fuel ratio detected by the LAF sensor becomes equal to the desired air-fuel ratio, while during the open-loop control, the coefficient KLAF is set to a predetermined value suitable for an operating condition of the engine in the open-loop control region.

KEVAP represents an evaporative fuel-dependent correction coefficient for compensating for the influence of purged evaporative fuel. The correction coefficient KEVAP is set to 1.0 when purging of evaporative fuel is not executed, and to a value within a range of 0 to 1.0 during execution of the purging. The KEVAP value is set to a smaller value as the influence of purged evaporative fuel is larger.

K1 and K2 represent other correction coefficients and correction variables, respectively, which are set based on various engine operating parameters to such values as optimize operating characteristics of the engine, such as fuel consumption and engine accelerability, depending on operating conditions of the engine.

The CPU 5*b* delivers a signal for driving the fuel injection valves 6 via the output circuit 5*d*, based on the results of the calculation described above.

Further, the CPU 5*b* delivers a command signal for changeover of the valve timing to thereby control opening and closing operations of the electromagnetic valve 21 according to operating conditions of the engine.

Figure 2A:
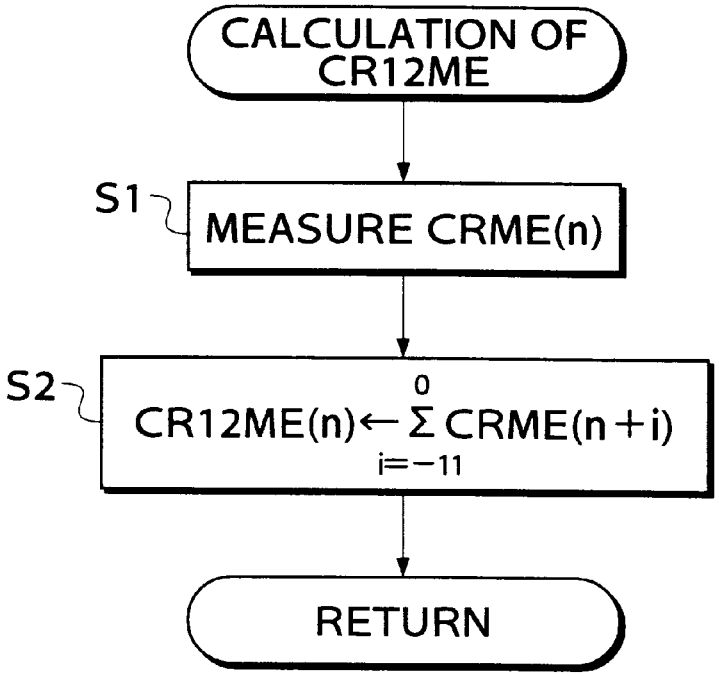
Figure 2B:
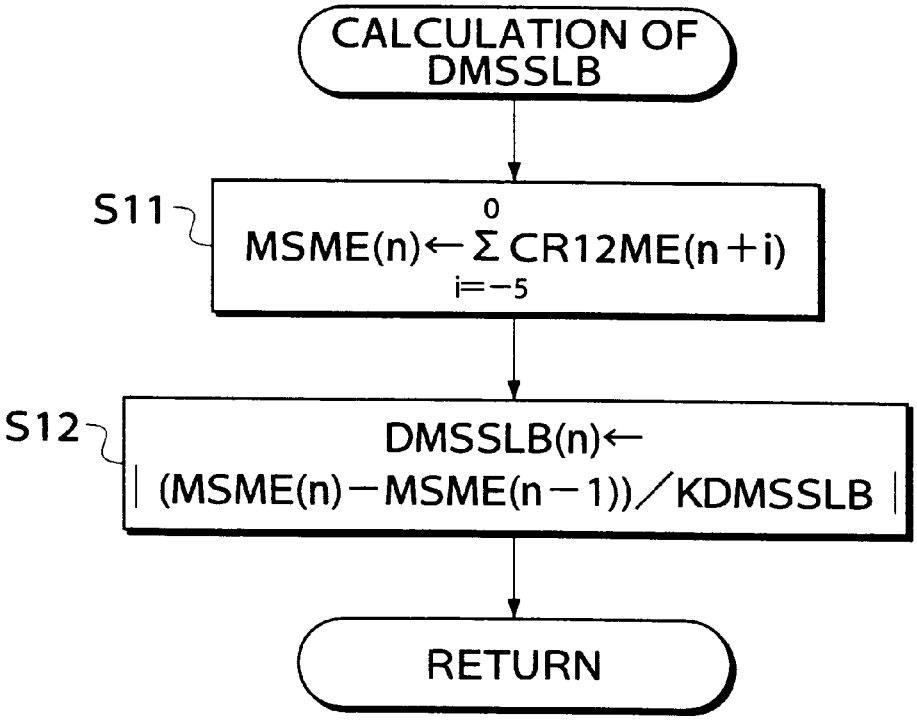

FIGS. 2A and 2B show routines for calculating a variation amount DMSSLB in the rotational speed of the engine for use in determining unstability of the engine combustion, which is executed by the CPU 5*b*.

Figure 3:
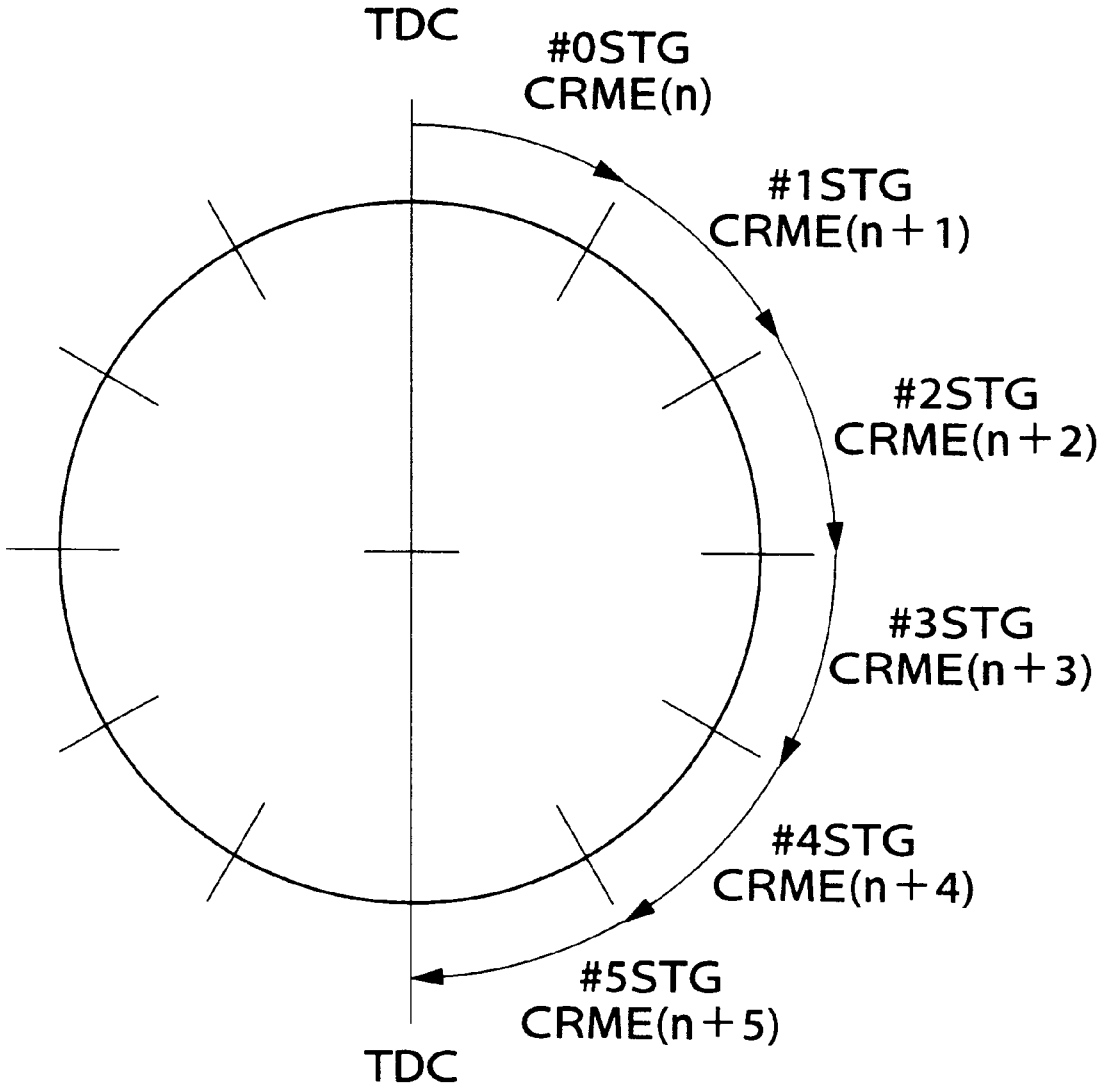
FIG. 3 is a diagram which is useful in explaining a manner of measuring a parameter indicative of the rotational speed of the engine with respect to the rotational angle of a crankshaft of the engine.

FIG. 2A shows a routine for carrying out a CRK process which is executed in synchronism with generation of each CRK signal pulse. First, at a step S1, time intervals CRMe (n) of generation of CRK signal pulses are calculated. More specifically, time interval values CRMe(n), CRMe(n+1), CRMe(n+2), . . . are successively measured whenever the crankshaft rotates through 30 degrees, as shown in FIG. 3.

In this connection, the repetition period of rotation of the crankshaft through 180 degrees is divided into #0 to #5 stages (#0STG to #5STG) each corresponding to each time period of rotation of the crankshaft through 30 degrees.

At a step S2, a first total value CR12ME(n) is calculated as a total value of twelve CRME values from the value CRME(n−11) measured eleven loops before the present loop to a value CRME(n) in the present loop, by the use of the following equation (2):

$$CR12Me(n) = \sum_{i=-11}^{0} CRME(n+i) \tag{2}$$

In the present embodiment, since the CRK signal pulses are each generated whenever the crankshaft rotates through 30 degrees, the first total value CR12ME(n) is obtained over one rotation of the crankshaft. Although, conventionally, a value obtained by dividing the first total value CR12ME(n) by twelve has been used as a CR12ME(n) value, this embodiment employs the total value so as to simplify the calculation. The first total value CR12ME thus obtained is free of the influence of primary vibration components of engine rotation over a period of one rotation of the crankshaft, i.e. noise components due to dimensional errors (such as manufacturing tolerances and mounting tolerances) of a pulser or a pickup forming the crank angle sensor 11.

The engine rotational speed NE is also calculated based on the CR12ME(n) value.

FIG. 2B shows a routine for carrying out a #3STG process, which is executed at a #3STG (#3 stage of FIG. 3) with the same repetition period as the repetition period of generation of TDC signal pulses. First, at a step S11, a second total value MSME(n) is calculated as a total value of six CR12ME values from a value CR12ME(n−5) obtained five loops before the present loop to a value CR12ME(n) in the present loop, by the use of the following equation (3):

$$MSME(n) = \sum_{i=-5}^{0} CRME(n+i) \tag{3}$$

In the present embodiment, the engine 1 is a 4-cylinder 4-cycle type engine, wherein spark ignition is carried out at any one of the cylinders whenever the crankshaft rotates through 180 degrees. Therefore, the second total value MSME(n) is obtained from the first total value CR12ME(n) over one firing period. Although, conventionally, a value obtained by dividing the second total value CR12ME(n) by six has been used as a MSME(n) value, this embodiment employs the total value so as to simplify the calculation. The second total value CR12ME thus obtained is free of secondary vibration components ascribed to variations in torque of the engine due to combustion, i.e. vibration components in engine rotation having a repetition period corresponding to half rotation of the crankshaft.

Next, a rotational speed variation amount DMSSLB(n) is calculated by the use of the following equation (4):

$$DMSSLB\ (n) = |(MSME(n) - MSME(n-1)/KDMSSLB| \tag{4}$$

where KDMSSLB represents a coefficient which is set to a value inversely proportional to the engine rotational speed NE so as to prevent the calculated rotational speed variation amount DMSSLB from varying with the engine rotational speed NE, whereby the accuracy of lean-burn control is maintained constant irrespective of the engine rotational speed NE.

Figure 4:
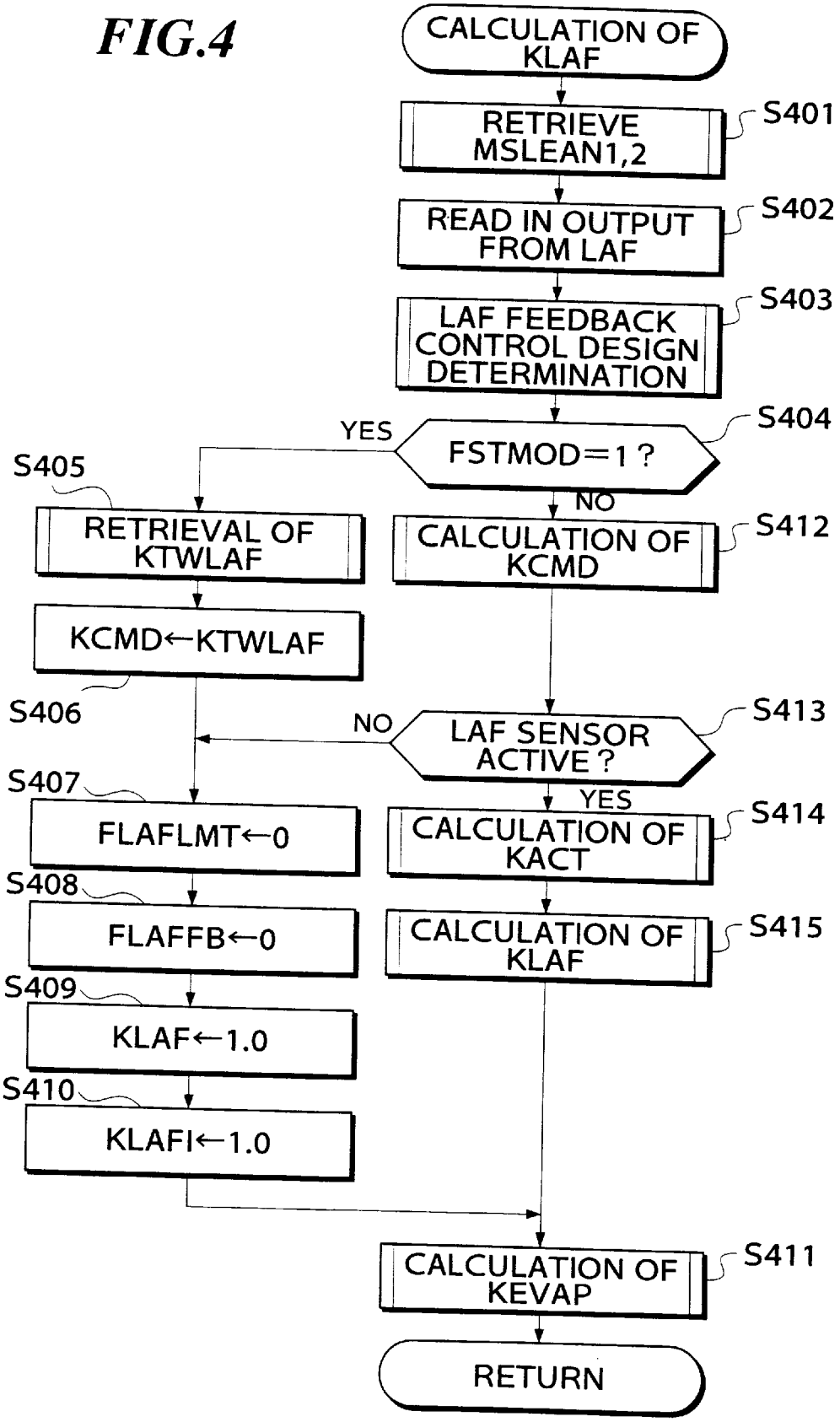
FIG. 4 is a flowchart showing a main routine for calculating a desired air-fuel ratio coefficient KCMDM and an air-fuel ratio correction coefficient KLAF.

FIG. 4 shows a routine for calculating the desired air-fuel ratio coefficient KCMD and the air-fuel ratio correction coefficient KLAF, which is executed by the CPU 5*b* in synchronism with generation of each TDC signal pulse.

Figure 18:
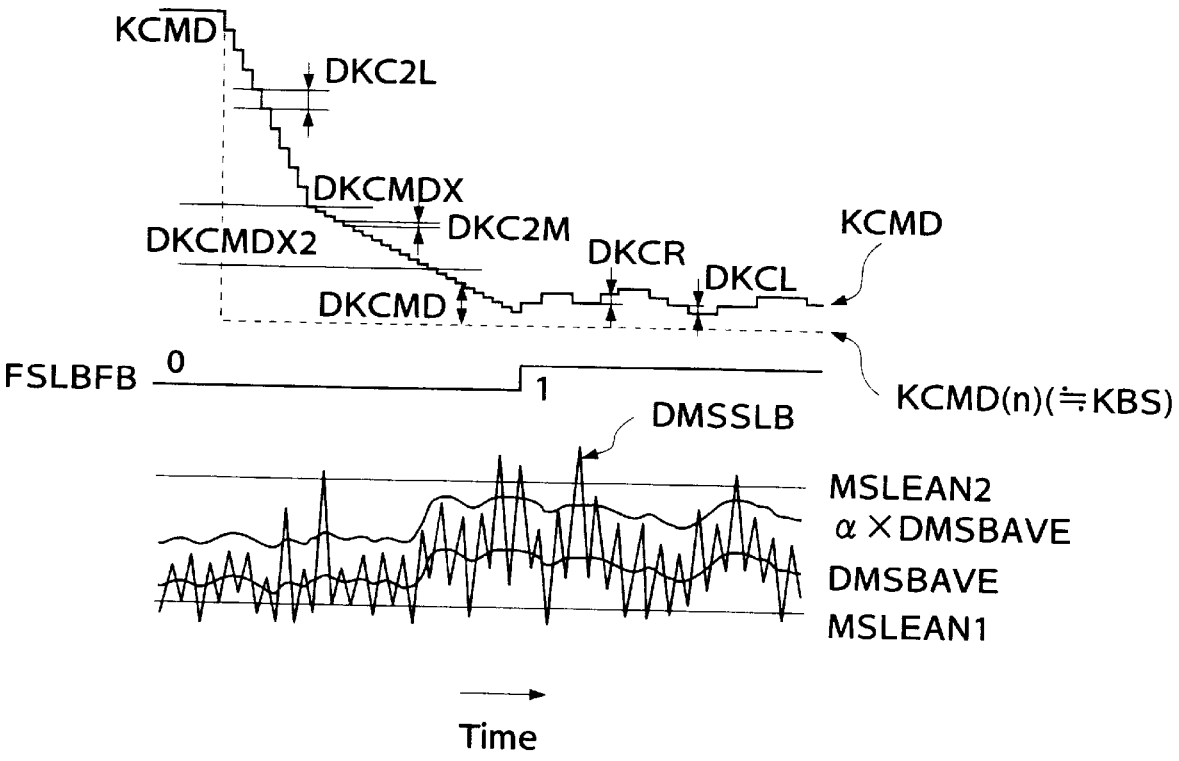
FIG. 18 is a diagram which is useful in explaining a manner of correcting the KCMD value according to the DMSSLB value.

First, at a step S401, a MSLEAN map is retrieved according to the engine rotational speed NE and the intake pipe absolute pressure PBA to determine upper and lower threshold values MSLEAN1 and MSLEAN2 (see FIG. 18) of the rotational speed variation amount DMSSLB for use in determining unstability of engine combustion.

Then, at a step S402, the output from the LAF sensor 15 is read and stored in the memory device 5*c* of the ECU 5, and at the following step S403, an LAF feedback control region-determining routine of FIG. 5, which will be described in detail hereinafter, is executed.

Next, it is determined at a step S404 whether or not the engine is in a starting mode. More specifically, it is determined whether or not a starting mode-determining flag FSTMOD, which, when set to "1", indicates that the engine is in the starting mode, assumes "1". If FSTMOD=1 holds at a step S405, a KTWIAF table is retrieved according to the engine coolant temperature TW to determine a low-temperature desired air-fuel ratio coefficient KTWLAF to be applied when the engine coolant temperature TW is low, and the coefficient KTWLAF is set to the KCMD value at a step S406. Then, a feedback limit flag FLAFLMT is set to "0" at a step S407, a flag FLAFFB, which, when set to "1", indicates that the LAF feedback control responsive to the output from the LAF sensor 15 is being executed, is set to "0" at a step S408, the air-fuel ratio correction coefficient KLAF is set to "1.0" at a step S409, and an air-fuel ratio correction coefficient integral term KLAF1 is set to "1.0" at a step S410. Further, the evaporative fuel-dependent correction coefficient KEVAP for compensating for the influence of purged evaporative fuel is calculated at a step S411, followed by terminating the program.

On the other hand, if the engine is not in the starting mode at the step S404, the program proceeds to a step S412, wherein the desired air-fuel ratio coefficient KCMD is determined by executing a subroutine shown in FIGS. 6 and 7, described hereinafter. Then, it is determined at a step S413 whether or not the LAF sensor 15 is activated. If the LAF sensor 15 is activated, an actually detected air-fuel ratio (hereinafter referred to "the actual air-fuel ratio") KACT is calculated at a step S414, based on the output from the LAF sensor 15. Then, at the following step S415, the air-fuel ratio correction coefficient KLAF is calculated such that the actual air-fuel ratio KACT becomes equal to the desired air-fuel ratio coefficient KCMD calculated at the step S412, followed by the program proceeding to the step S411 for calculating the evaporative fuel-dependent correction coefficient KEVAP.

If the LAF sensor 15 is not activated at the step S413, the program proceeds from the step S407 to the step S411, without calculating the actual air-fuel ratio KACT based on the output from the LAF sensor 15.

Figure 5:
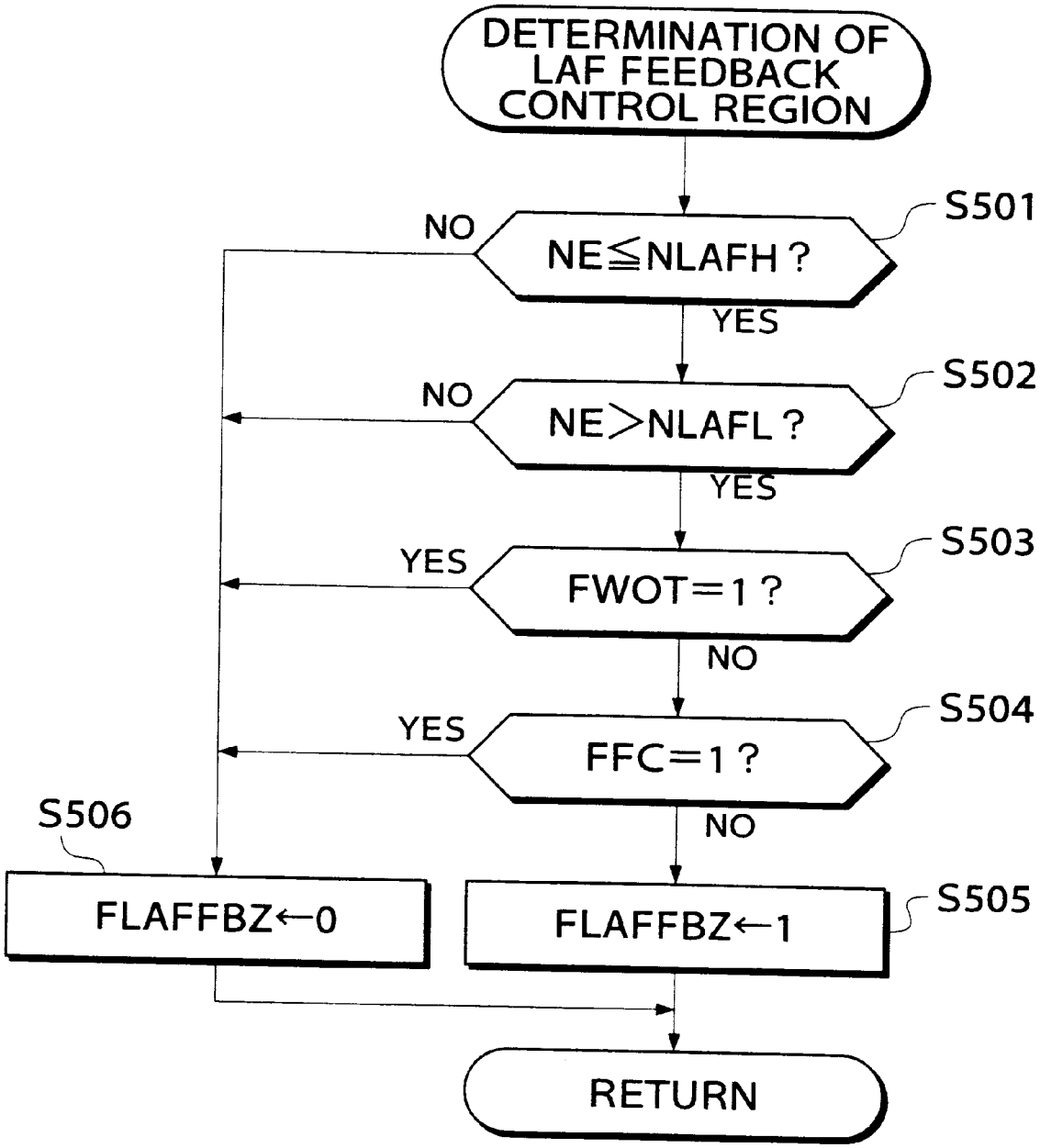
FIG. 5 is a flowchart showing a subroutine for carrying out an LAF feedback control region-determining process, which is executed at a step S403 in FIG. 4.

FIG. 5 shows the LAF feedback control region-determining subroutine, which is executed at the step S403 in FIG. 4.

In the figure, first, it is determined at steps S501 and S502 whether or not the engine rotational speed NE is within a predetermined range. More specifically, first, at the step S501, it is determined whether or not the engine rotational speed NE is equal to or lower than an upper limit value NLAFH of the predetermined range. If NE>NLAFH holds, it is judged that conditions for carrying out the air-fuel ratio feedback control are not fulfilled, and an LAF feedback control region-determining flag FLAFFBZ, which, when set to "1", indicates that the conditions for carrying out the air-fuel ratio feedback control are fulfilled, is set to "0" at a step S506, followed by terminating the program.

If NE≦NLAFH holds at the step S501, the program proceeds to a step S502, wherein it is determined whether or not the NE value is higher than a lower limit value NLAFL of the predetermined range. If NE≦NLAFL holds, it is also judged that the conditions for carrying out the air-fuel ratio feedback control are not fulfilled, and the LAF feedback control region-determining flag FLAFFBZ is set to "0" at the step S506, followed by terminating the program.

On the other hand, if NE>NLAFL holds at the step S502, it is judged that the engine rotational speed NE is within the predetermined range, and the program proceeds to a step S503. At the step S503, it is determined whether or not a WOT flag FWOT, which, when set to "1", indicates that the engine 1 is in a WOT (wide-open-throttle) region, assumes "1". If the flag FWOT assumes "1", it is judged that the conditions for carrying out the air-fuel ratio feedback control are not fulfilled, and the LAF feedback control region-determining flag FLAFFBZ is set to "0" at the step S506, followed by terminating the program. In this connection, at the steps S501 and S502, the upper and lower limit values NLAFH and NLAFL are each provided with a hysteresis for preventing the air-fuel feedback control from becoming unstable. More specifically, the upper and lower limit values NLAFH and NLAFL each comprise two larger and smaller values, and when the engine rotational speed NE approaches the lower limit value NLAFL or the upper limit value NLAFH in an increasing direction, the larger values are employed as the upper and lower limit values, whereas when the engine rotational speed NE approaches the upper limit value NLAFH and the lower limit value NLAFL in a decreasing direction, the smaller values are employed as the upper and lower limit values.

If the flag FWOT assumes "0" at the step S503, it is determined at a step S504 whether or not a flag FFC, which, when set to "1", indicates that the engine 1 is in a fuel-cut condition, assumes "1". If the flag FFC assumes "1", it is judged that the conditions for carrying out the air-fuel ratio feedback control are not fulfilled, and the flag FLAFFBZ is set to "0" at the step S506, followed by terminating the program.

On the other hand, if the flag FFC assumes "0" at the step S504, it is judged that the engine 1 is not in the fuel-cut condition, which means that the conditions for carrying out the air-fuel ratio feedback control are fulfilled, and the LAF feedback control region-determining flag FLAFFBZ is set to "1" at a step S505, followed by terminating the program.

Next, the subroutine for determining the desired air-fuel ratio coefficient KCMD, which is executed at the step S412 in FIG. 4, will be described with reference to FIG. 6 and FIG. 7. This process is executed in synchronism with generation of each TDC signal pulse.

Figure 6:
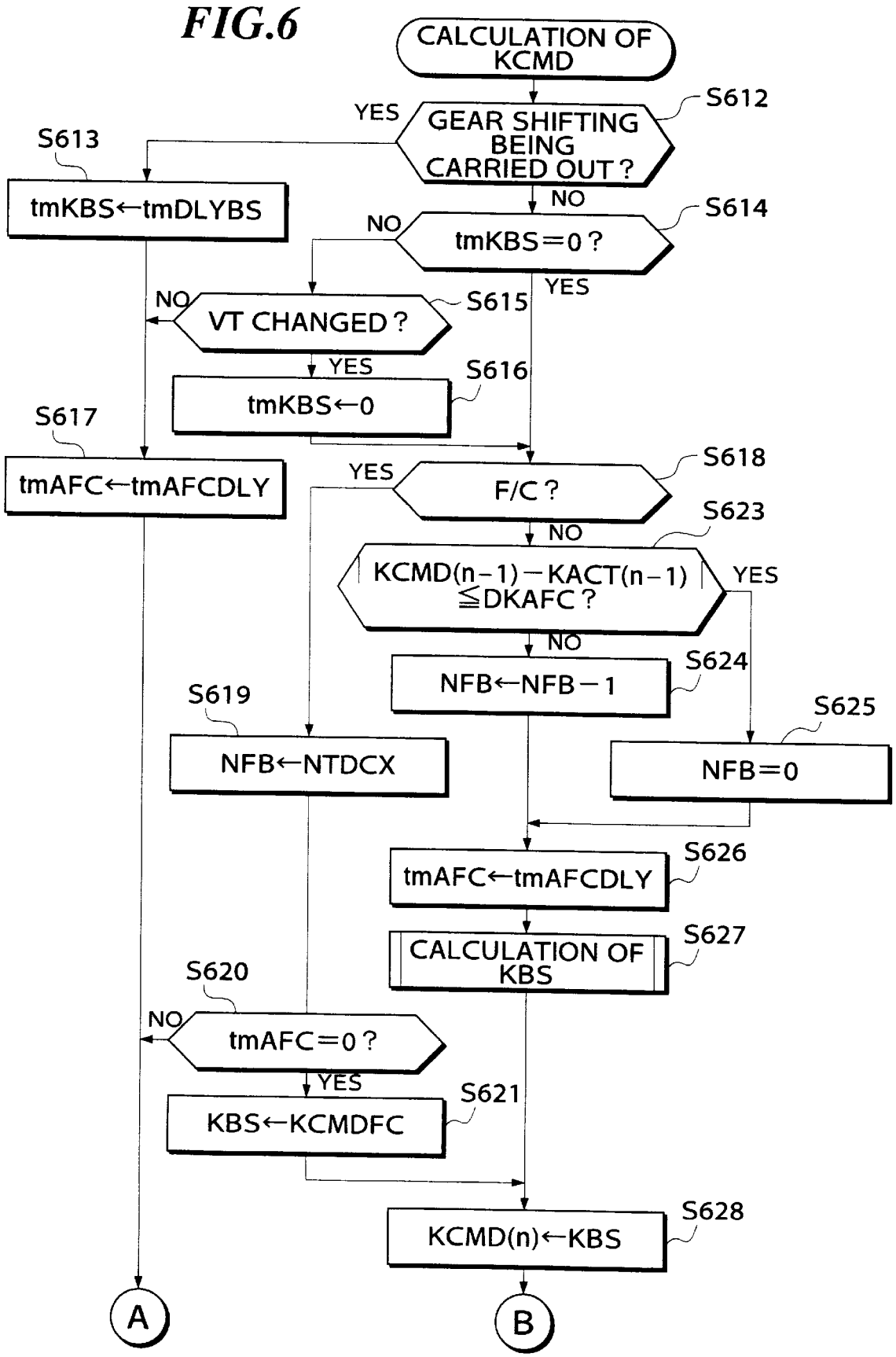
FIG. 6 is a flowchart showing a subroutine for calculating the desired air-fuel ratio coefficient KCMD, which is executed at a step S412 in FIG. 4.
Figure 7:
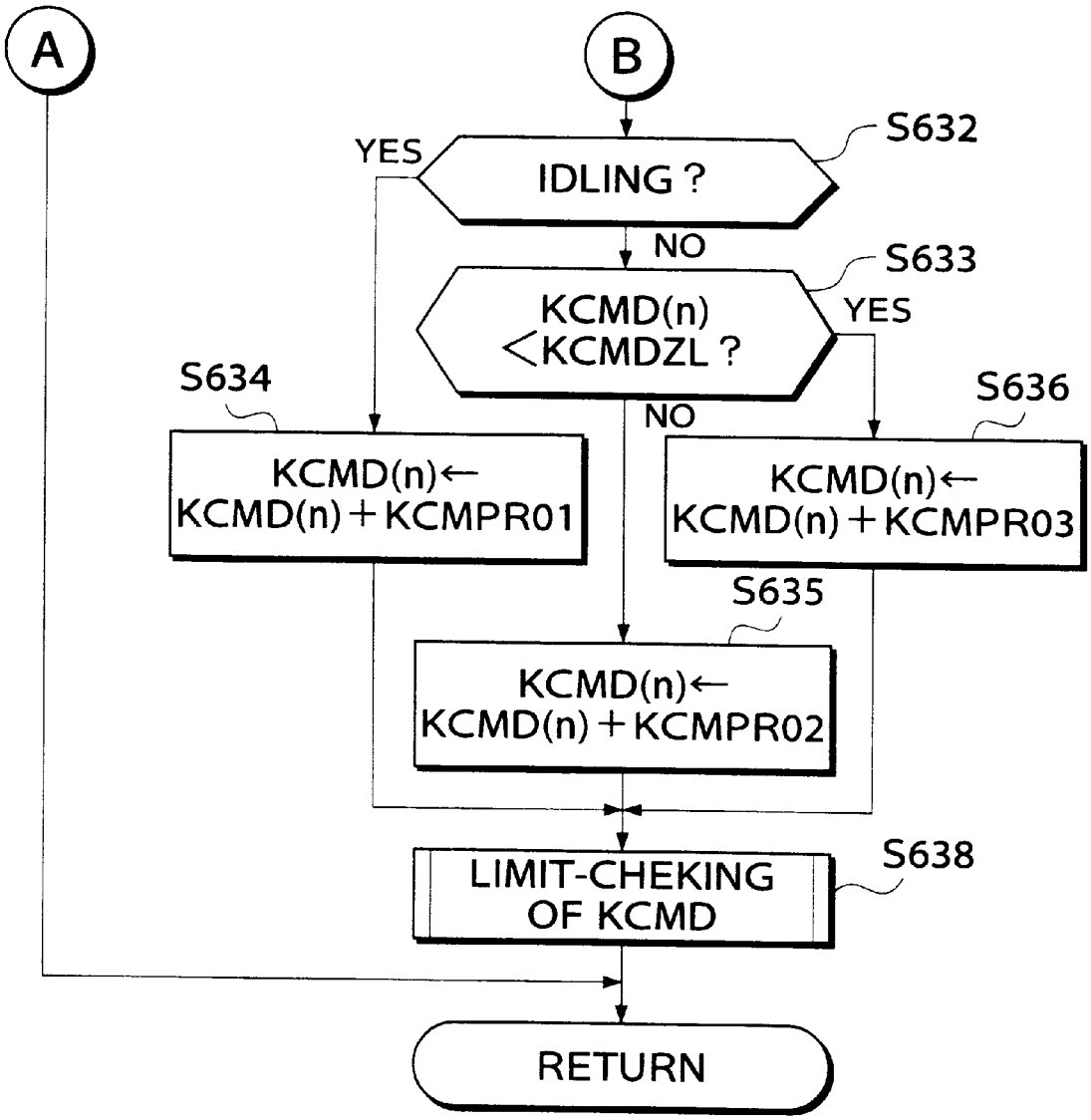
FIG. 7 is a continued part of the FIG. 6 flowchart.

First, at a step S612 in FIG. 6, it is determined whether or not gear shifting of the transmission is being carried out. This determination is carried out based on the output from the clutch sensor 18 which detects the engagement of the clutch. If gear shifting is being effected, a tmKBS gear shifting delay timer for measuring a time period elapsed after completion of the gear shifting is set to a predetermined gear shifting delay time period tmDLYBS (e.g. 50 milliseconds) and started at a step S613. Then, an F/C delay timer for measuring a duration of fuel-cut is set to a predetermined F/C delay time period tmAFCDLY (300 milliseconds) and started at a step S617, followed by terminating the program.

If the answer to the question of the step S612 is negative (NO), i.e. if gear shifting is not being carried out, it is determined at a step S614 whether or not the count of the tmKBS timer is equal to "0". If the answer is affirmative (YES), i.e. if the predetermined time period tmDLYBS has elapsed after the completion of the gear shifting, the program immediately proceeds to a step S618, whereas if the answer is negative (NO), i.e. if the predetermined time period tmDLYBS has not elapsed after the completion of the gear shifting, it is determined at a step S615 whether or not the valve timing has been changed. If the answer to the question of the step S615 is negative (NO), the program proceeds to the step S617, whereas if the answer is affirmative (YES), the tmKBS delay timer is reset to "0" at a step S616, followed by the program proceeding to the step S618.

At the step S618, it is determined whether or not fuel cut is being carried out. If the answer to the question is affirmative (YES), a TDC counter NFB is set to a predetermined count NTDCX (e.g. 6) at a step S619, and it is determined at a step S620 whether or not the count of the tmAFC timer is equal to "0". The TDC counter NFB is provided for changing the control gain of the air-fuel ratio feedback control according to the number of TDC signal pulses generated after termination of fuel cut. If the answer to the question of the step S620 is negative (NO), i.e. if the duration of the fuel-cut is shorter than the predetermined time period tmAFCDLY, the program is immediately terminated. On the other hand, if the answer to the question of the step S620 is affirmative (YES), i.e. if the duration of the fuel-cut has exceeded the predetermined time period tmAFCDLY, a desired air-fuel ratio coefficient KBS to be applied during execution of lean-burn control is set to a predetermined value KCMDFC, which is equivalent to a stoichiometric air-fuel ratio (A/F=14.7), at a step S621. Then, the KCMD value is set to the KBS value at a step S628, followed by the program proceeding to a step S632 (FIG. 7).

As described above, in the present embodiment, when the duration of fuel-cut is short (i.e. shorter than tmAFCDLY), the program is immediately terminated, whereas when the duration of fuel-cut has exceeded the predetermined time period tmAFCDLY, the KBS value is set to the predetermined value KCMDFC equivalent to the stoichiometric air-fuel ratio. Therefore, it is possible to properly control the air-fuel ratio of the mixture supplied to the engine 1 immediately after completion of the fuel cut. That is, when the duration of fuel-cut is short, almost no change occurs in the operating condition of the engine. Therefore, by resuming the feedback control by the use of the KBS value obtained immediately before the start of the fuel cut, it is possible to promptly obtain a desirable supply air-fuel ratio. On the other hand, when the duration of fuel cut is long, the KBS value is set to the stoichiometric air-fuel ratio. Therefore, the KBS value can promptly follow up a value set according to an operating condition of the engine immediately after termination of fuel cut, irrespective of whether the KBS value is leaner or richer than the stoichiometric air-fuel ratio.

If the answer to the question of the step S618 is negative (NO), i.e. if fuel cut is not being carried out, it is determined at a step S623 whether or not the absolute value of the difference between the immediately preceding value KCMD (n−1) of the coefficient KCMD and the immediately preceding value KACT(n−1) of the actual air-fuel ratio KACT is equal to or smaller than a predetermined value DKAFC (e.g. a value equivalent to an A/F ratio of 0.8). If the answer to the question of the step S623 is affirmative (YES), i.e. if the difference is equal to or smaller than the predetermined value DKAFC, the TDC counter NFB is reset to "0" at a step S625. On the other hand, if the answer is negative (NO), the count of the NFB counter is decremented by "1" at a step S624, followed by the program proceeding to a step S626.

According to the above steps S623 to S625, when the difference between the desired air-fuel ratio coefficient KCMD and the actual air-fuel ratio KACT is larger than the DKAFC value immediately after fuel cut is completed, the count NFB of the TDC counter NFB is set to a value equal to or larger than "1", which is used in a routine, not shown, for setting the control gain of the air-fuel ratio feedback control to a smaller value than when NFB=0 holds.

Figure 8:
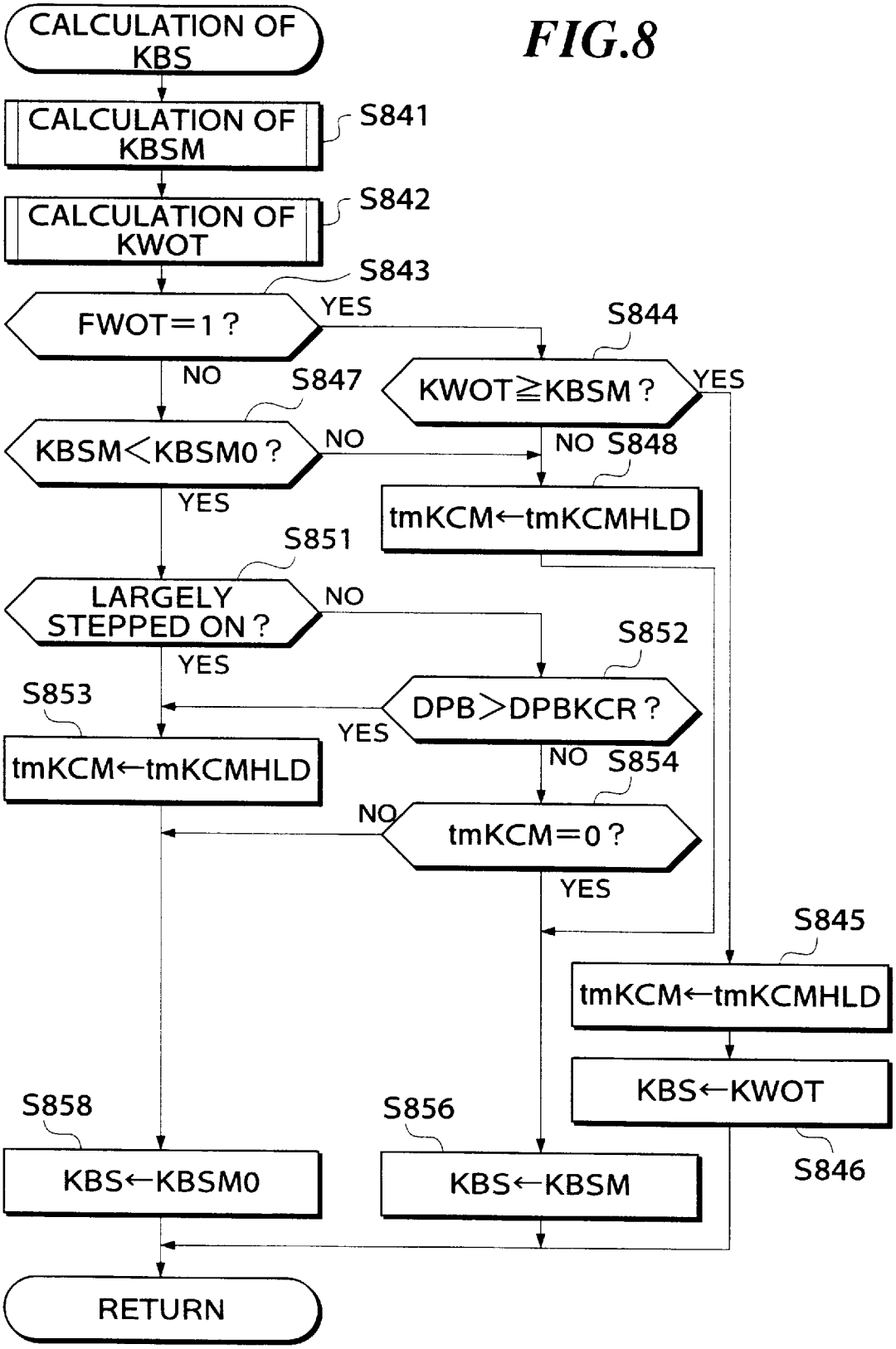
FIG. 8 is a flowchart showing a subroutine for calculating a basic value KBS of the desired air-fuel ratio coefficient KCMD, which is executed at a step S626 in FIG. 6.

At the step S626, the F/C delay timer is set to the predetermined time period tmAFCDLY and started, and then at a step S627, the basic value KBS of the desired air-fuel ratio coefficient KCMD is determined by executing a subroutine described hereinbelow with reference to FIG. 8. At the following step S628, the KCMD value is set to the KBS value, followed by the program proceeding to a step S632 (FIG. 7).

At the step S632, it is determined whether or not the engine is idling. If the answer to the question is affirmative (YES), the first mass production-dependent correction variable KCMPRO1 set according to the output voltage of the voltage regulator 51 is added to the KCMD value at a step S634, followed by the program proceeding to a step S638. If the answer to the question of the step S632 is negative (NO), i.e. if the engine is not idling, it is determined at a step S633 whether or not the KCMD value is smaller than a lean burn-determining reference value KCMDZL (equivalent to an A/F ratio of e.g. 18) which is leaner than the stoichiometric air-fuel ratio to thereby determine whether the lean-burn control is being executed. If the answer to the question is negative (NO), i.e. if KCMD≧KCMDZL holds, it is judged that lean-burn control is not being carried out, and the second mass production-dependent correction variable KCMPRO2 set according to the output voltage of the voltage regulator 51 is added to the KCMD value at a step S635, followed by the program proceeding to the step S638. On the other hand, if the answer to the question of the step S633 is affirmative (YES), i.e. if KCMD<KCMDZL holds, which means that the lean-burn control is being carried out, the third mass production-dependent correction variable KCMPRO3 set according to the output voltage of the voltage regulator 51 is added to the KCMD value at a step S636, followed by the program proceeding to the step S638.

According to the steps S632 to S636, when the engine is idling, the first mass production-dependent correction variable KCMPRO1 is applied, whereas when the engine is in an operating condition other than idling, the second or third mass production-dependent correction variable KCMPRO2 or KCMPRO3 is applied depending on whether the desired air-fuel ratio coefficient KCMD is smaller than the lean-burn-determining reference value KCMDZL. Therefore, it is possible to carry out mass production dependent correction in a manner suitable for each engine operating condition and desired air-fuel ratio, without degrading exhaust emission characteristics and driveability of the engine. This is particularly advantageous in that stable exhaust emission characteristics of the engine during idling can be maintained and it is possible to prevent a misfire and fluctuations in the engine rotational speed during execution of the lean-burn control.

Figure 14:
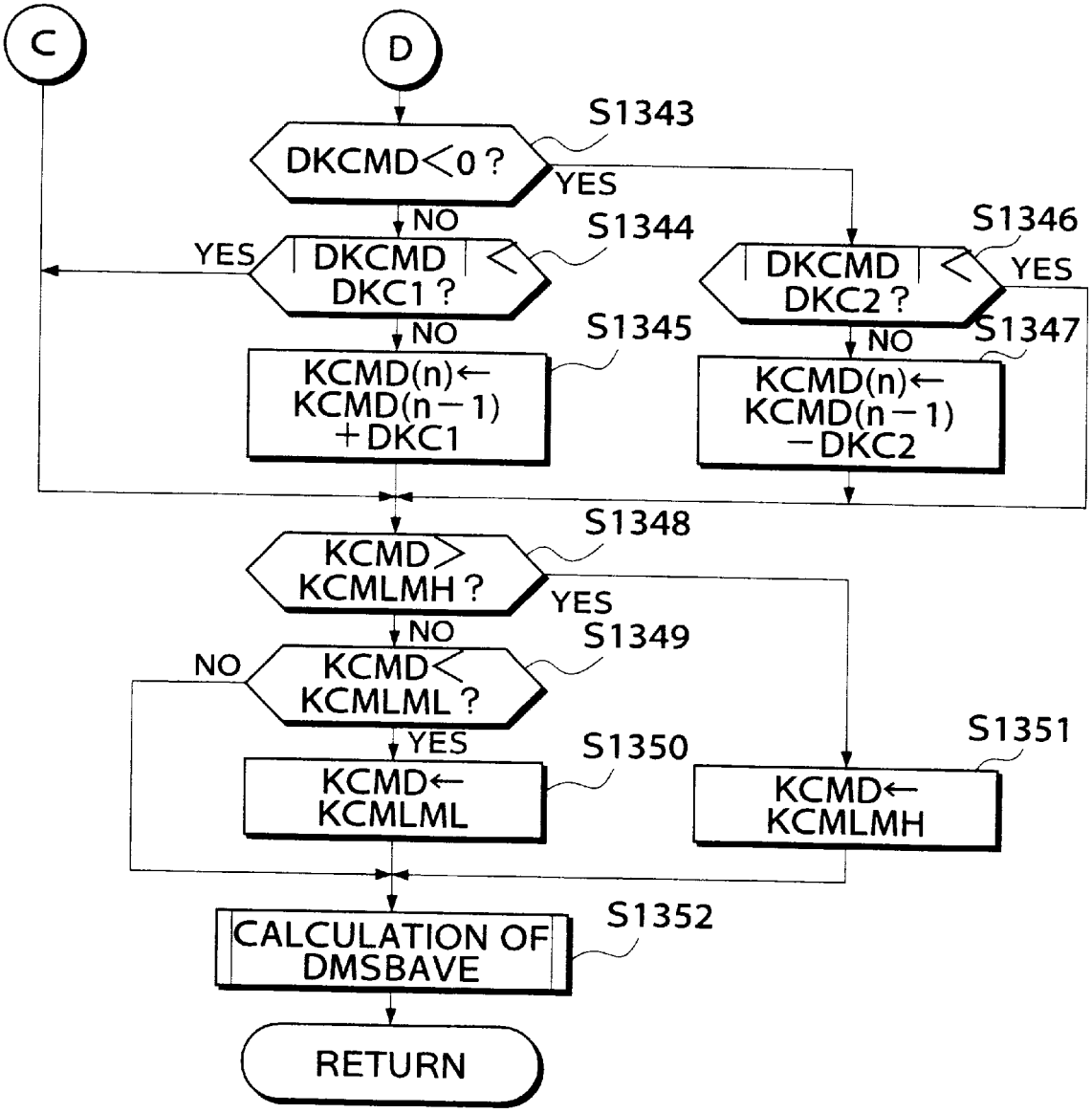
FIG. 14 is a continued part of the FIG. 13 flowchart.

At the step S638, limit-checking of the KCMD value is carried out by executing a subroutine described hereinafter with reference to FIGS. 13 and 14. This limit-checking is executed in order to prevent the difference between the immediately A preceding value and the present value of the KCMD value from exceeding the upper limit value set according to operating conditions of the engine, to thereby inhibit the KCMD value from changing drastically. However, when the KCMD value is leaner than the stoichiometric air-fuel ratio and at the same time an accelerator pedal of the vehicle is suddenly and largely stepped on, the KCMD value is immediately caused to be increased to a value equivalent to the stoichiometric air-fuel ratio.

Next, the subroutine for calculating the basic value KBS of the desired air-fuel ratio coefficient KCMD, which is executed at the step S627 in FIG. 6, will be described with reference to FIG. 8.

First, at a step S841, a KBS-setting basic value KBSM based on which the basic value KBS is determined is calculated by executing a subroutine described hereinafter with reference to FIG. 9.

Then, a high-load desired air-fuel ratio coefficient KWOT suitable for a predetermined high-load operating condition of the engine is calculated at a step S842. The KWOT value is read from a KWOT map according to the engine rotational speed NE and the intake pipe absolute pressure PBA. At a step S843, it is determined whether or not a flag FWOT, which, when set to "1", indicates that the engine is in the predetermined high-load operating condition, assumes "1". If the answer to the question of the step S843 is affirmative (YES), i.e. if the engine is in the predetermined high-load operating condition, it is determined at a step S844 whether or not the KWOT value is equal to or larger than the KBSM value. If the answer to the question is affirmative (YES), i.e. if KWOT≧KBSM holds, a tmKCM timer for measuring an elapsed time period at a step S854, referred to hereinafter, is set to a predetermined time period tmKCMHLD (e.g. 2 seconds) and started at a step S845, and then the KBS value is set to the KWOT value at a step S846, followed by terminating the program.

On the other hand, if the answer to the question of the step S844 is negative (NO), i.e. if KWOT<KBSM holds, the same processing as carried out at the step S845 is executed at a step S848, and then the KBS value is set to the KBSM value at a step S856, followed by terminating the program.

If the answer to the question of the step S844 is negative (NO), i.e. if the engine is not in the predetermined high-load operating condition, it is determined at a step S848 whether or not the KBS-setting basic value KBSM is smaller than a predetermined value KBSM0 which is equivalent to the stoichiometric air-fuel ratio. If the answer to the question is negative (NO), i.e. if KBSM≧KESM0 holds, the program proceeds to the step S848, whereas if the answer is affirmative (YES), i.e. if KBSM<KBSM0 holds, it is determined at a step S851 whether or not the accelerator pedal has been largely stepped on, i.e. whether or not an amount of change in the throttle valve opening θTH (a value obtained by subtracting a θTH value detected in the last loop from a θTH value detected in the present loop) is larger than a positive predetermined value (e.g. 4 degrees). If the answer to the question of the step S851 is affirmative (YES), similarly to the step S845, the tmKCM timer is set to the predetermined time period tmKCMHLD and started at a step S853, and the KBS value is set to the predetermined value KBSM0 equivalent to the stoichiometric air-fuel ratio at a step S858, followed by terminating the program.

On the other hand, if the answer to the question of the step S851 is negative (NO), i.e. if the amount of change in the throttle valve opening θTH is smaller than the positive predetermined value, it is determined at a step S852 whether or not an amount of change DPB in the intake pipe absolute pressure PBA (a value obtained by subtracting a PBA value detected in the last loop from a PBA value detected in the present loop) is larger than a predetermined value DPBKCR (e.g. 80 mmHg). If the answer to the question of the step S852 is affirmative (YES), i.e. if DPB>DPBKCR holds, the program proceeds to the step S853, whereas if the answer is negative (NO), i.e. if DPB≦DPBKCR holds, it is determined at the step S854 whether or not the count tmKCM of the tmKCM timer is equal to "0". If the answer to the question is negative (NO), i.e. if tmKCM>0 holds, the program proceeds to the step S858, whereas if the answer is affirmative (YES), the program proceeds to the step S856.

Next, the subroutine for calculating the KBS-setting basic value KBSM, which is executed at the step S841 in FIG. 9, will be described with reference to FIG. 9.

First, at a step S901, it is determined from the evaporative fuel-dependent correction coefficient KEVAP whether or not the execution of the lean-burn control is permitted. The lean-burn control is permitted when the evaporative fuel-dependent correction coefficient KEVAP is larger than a predetermined value, i.e. when an amount of purged evaporative fuel is small, whereas it is inhibited when the coefficient KEVAP is smaller than the predetermined value, i.e. when the amount of purged evaporative fuel is large.

If it is determined at the step S901 from the evaporative fuel-dependent correction coefficient KEVAP that the lean-burn control is permitted, it is determined at a step S902 from results of a misfire detection whether or not the lean-burn control is permitted. The lean-burn control is permitted when no misfire occurs in the engine, whereas when a misfire occurs in the engine, it is judged that the engine is in an unstable combustion state, so that execution of the lean-burn control is inhibited.

If it is determined at the step S902 from results of the misfire detection that the lean-burn control is permitted, the program proceeds to a step S903, wherein it is determined whether or not the engine coolant temperature TW is higher than a predetermined lower reference value TWLEAN5. If TW>TWLEAN5 holds at the step S903, the program proceeds to a step S904, wherein it is determined whether or not the engine coolant temperature TW is lower than a predetermined higher reference value TWLEAN.

If TW≧TWLEAN holds at the step S904, the program proceeds to a step S906, wherein a desired air-fuel ratio coefficient KTWLAF to be applied when the engine coolant temperature is low is set to an initial value of "1.0".

If TW<TWLEAN holds at the step S904, the program proceeds to a step S905, wherein it is determined whether or not a gear position-determining value NGR which indicates a selected gear position of the transmission is equal to a value indicative of a fifth speed position. If NGR=5 holds at the step S905, it is judged that the engine combustion is stable even if the engine coolant temperature TW is lower than the higher reference value TWLEAN, and then the desired air-fuel ratio coefficient KTWLAF is set to the initial value of "1.0" at the step S906.

Then, at the following step S907, a KBSM map is retrieved by executing a subroutine described hereinafter with reference to FIG. 10, followed by the program proceeding to a step S908.

If it is determined from the evaporative fuel-dependent correction coefficient KEVAP at the step S901 that the lean-burn control is inhibited, or if it is determined from results of the misfire detection at the step S902 that the lean-burn control is inhibited, or if TW≦TWLEAN5 holds at the step S903, or if NGR ≠5 holds at the step S905, then the program proceeds to a step S909, wherein a KTWLAF table for use in determining the desired air-fuel ratio coefficient KTWLAF is retrieved to determine the coefficient KTWLAF. The KTWLAF table is set such that the KTWLAF value decreases as the engine coolant temperature becomes higher.

Then, at a step S910, it is determined whether or not the KTWLAF value determined at the step S909 is smaller than the predetermined value KBSM0 which is equivalent to the stoichiometric air-fuel ratio. If KTWLAF≧KBSM0 holds at the step S910, the KBSM value is set to the KTWLAF value at a step S911, whereas if KTWLAF<KBSM0 holds, the KBSM value is set to the predetermined value KBSM0 at a step S912, in each case followed by the program proceeding to the step S908. At the step S908, it is determined whether or not the engine 1 is idling. If the engine 1 is not idling, the count tmKBSIDL of a tmKBSIDL timer for measuring a predetermined time period elapsed after the start of idling of the engine 1 is set at the step S912, followed by terminating the program.

If the engine 1 is idling at the step S908, the program proceeds to a step S913, wherein it is determined whether or not the engine coolant temperature TW is equal to or higher than the predetermined higher reference value TWLEAN. If TW≧TWLEAN holds at the step S913, the program proceeds to a step S914, wherein it is determined whether or not the count tmKBSIDL of the tmKBSIDL timer is equal to "0". If the count tmKBSIDL is equal to "0" at the step S914, the KES-setting basic value KBSM is set to a leaner desired air-fuel ratio KBSIDL suitable for idling of the engine at a step S915. If the count tmKBSIDL is not equal to "0", which means that the predetermined time period has not elapsed after the start of idling of the engine, the KBSM value is set to a richer desired air-fuel ratio KBSIDLR suitable for idling of the engine, which is richer than the leaner desired air-fuel ratio KBSIDL, at a step S916, followed by terminating the program.

Next, the subroutine for retrieving the KBSM map for determining the KBS-setting basic value, which is executed at the step S907 in FIG. 9, will be described with reference to FIG. 10.

First, at a step S1001, the KBSM map is retrieved according to the intake pipe absolute temperature PBA and the engine rotational speed NE to determine the KBS-setting basic value KBSM.

Then, at a step S1002, the value of a lean-burn control-permitting flag FKBSMJG, which, when set to "0", indicates that execution of the lean-burn control is permitted is set by executing a subroutine described hereinafter with reference to FIG. 11.

Then, at a step S1004, it is determined whether or not the flag FKBSMJG set at the step S1002 assumes "1". If the flag FKBSMJG assumes "0" at the step S1004, i.e. if the lean-burn control is permitted, the program proceeds to a step S1005, wherein it is determined whether or not an air-fuel ratio-enriching flag FMSFBRICH, which, when set to "1" by a subroutine described hereinafter with reference to FIG. 16, indicates that the desired air-fuel ratio has been enriched to a predetermined value KCMDFBH, assumes "1".

If the Flag FMSFBRICH assumes "1" at the step S1005, the program proceeds to a step S1006, wherein it is determined whether or not the gear position is higher than a fourth speed position. If the gear position is higher than the fourth speed position at the step S1006, or if the flag FMSFBRICH assumes "0" at the step S1005, the program proceeds to a step S1007, wherein it is determined whether or not the gear position is higher than a third speed position.

On the other hand, if the flag FKBSMJG assumes "1", i.e. if the lean-burn control is inhibited at the step S1004, or if the gear position is equal to or lower than the fourth speed position at the step S1006 or the third speed position at the step S1007, then the KBS-setting basic value KBSM is set to the predetermined value KMSM0 equivalent to the stoichiometric air-fuel ratio, at a step S1008, followed by terminating the program. If the gear position is higher than the third speed position at the step S1007, the program is immediately terminated. It goes without saying that if the gear position is higher than the fourth position at the step S1006, the gear position is necessarily judged to be higher than the third speed position at the step S1007.

Figure 10:
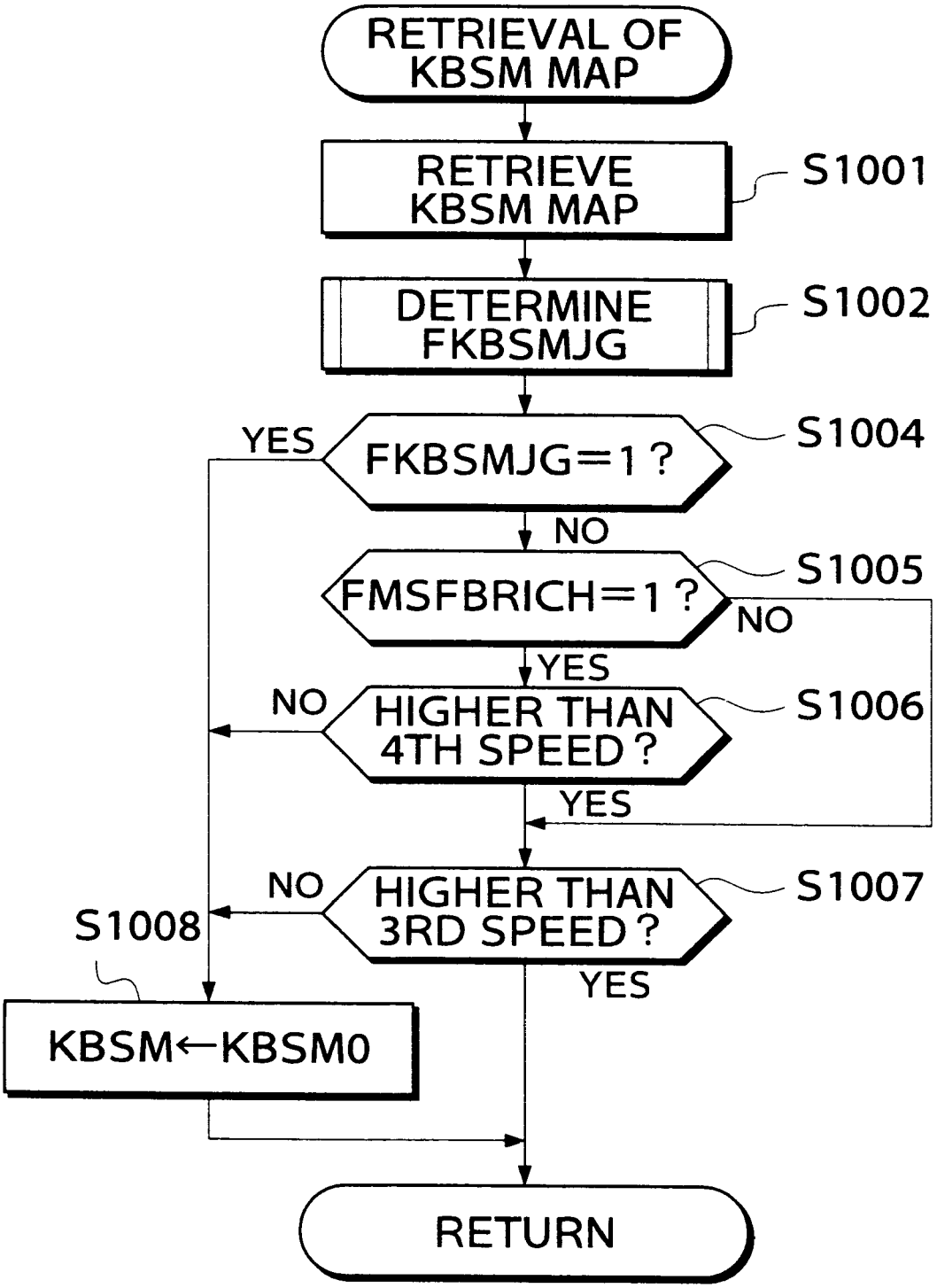
FIG. 10 is a flowchart showing a subroutine for retrieving a KBSM map, which is executed at a step S907 in FIG. 9.

According to the FIG. 10 subroutine, when the enriching correction amount of the KCMD value during the lean-burn feedback control is larger than the predetermined value (i.e. FMSFBRICH=1), only if the gear position (which is usually the third speed position) is higher than the fourth speed position, the lean-burn feedback control of the air-fuel ratio is permitted. That is, the lean-burn feedback control is permitted only when the gear position is a higher speed position where the engine combustion is stable, to thereby prevent Nox from unnecessarily generated.

Next, the subroutine for determining the value of the lean-burn control-permitting flag FKBSMJG, which is executed at the step S1002 in FIG. 10, will be described with reference to FIG. 11.

First, at a step S1101, it is determined whether or not the desired air-fuel ratio coefficient KCMD is smaller than a predetermined value KCMD0 which is equivalent to the stoichiometric air-fuel ratio. If KCMD<KCMD0 holds at the step S1101, i.e. if the air-fuel ratio of the mixture supplied to the engine is leaner than the stoichiometric air-fuel ratio, the program proceeds to a step S1102, wherein it is determined whether or not an engine load flag FBKBS, which is set at steps S1109 and S1110, referred to hereinafter, assumes "1".

Figure 12:
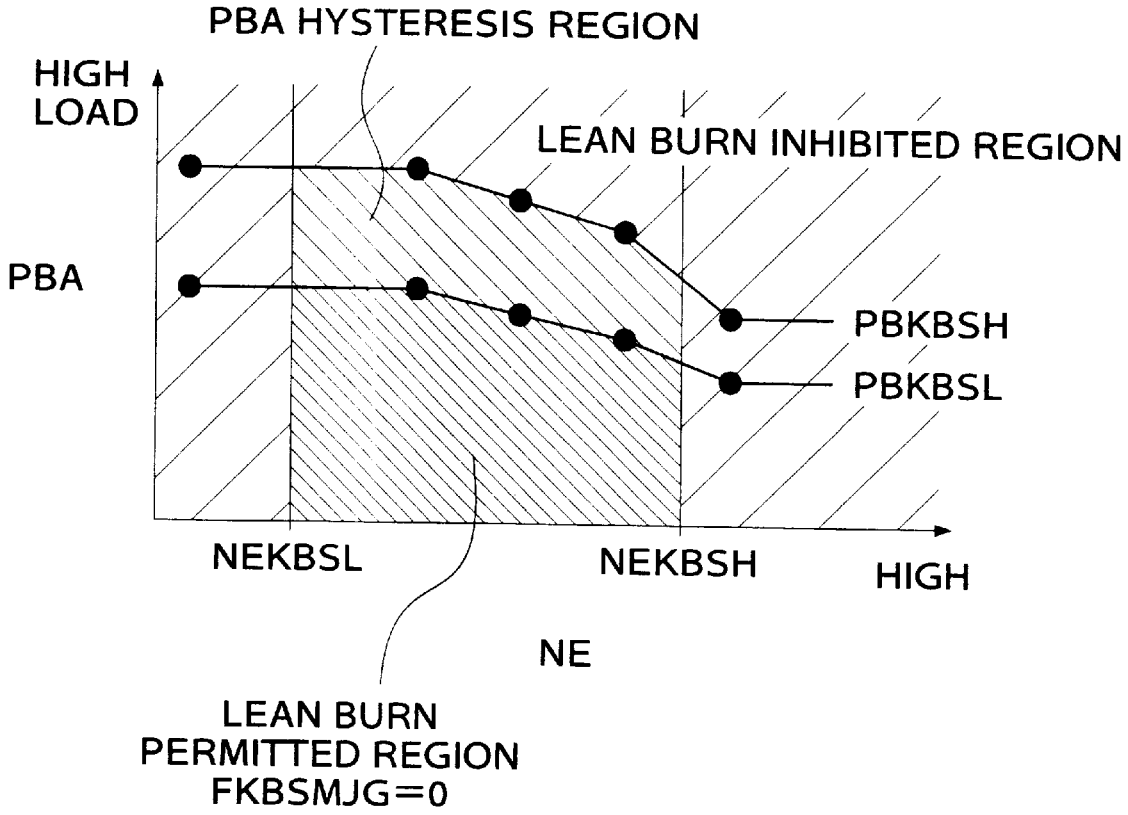
FIG. 12 shows a table for determining upper and lower PBA reference values PBKBSH/L of intake pipe absolute pressure PBA to set the flag FKBSMJG.

If KCMD≧KCMD0 holds at the step S1101, i.e. if the air-fuel ratio of the mixture is richer than the stoichiometric air-fuel ratio, or if the flag FPBKBS assumes "1" at the step S1102, the program proceeds to a step S1103, wherein a PBKBSL table as part of a table shown in FIG. 12 is retrieved to determine a lower reference value PBKBSL of the intake pipe absolute pressure PBA, followed by the program proceeding to a step S1108. On the other hand, if the flag FPBKBS assumes "0" at the step S1102, the program proceeds to a step S1104, wherein a PBKBSH table as part of the FIG. 12 table is retrieved to determine a higher reference value PBKBSH of the intake pipe absolute pressure PBA.

The table of FIG. 12 is for use in not only determining the higher and lower reference values PBKBSH/L but also setting the lean-burn control-permitting flag FKBSMJG. In FIG. 12, the abscissa indicates the engine rotational speed NE, and the ordinate indicates the intake pipe absolute pressure PBA indicative of the engine load. The region in which the engine rotational speed NE falls in a range between a lower limit value NEKBSL and an upper limit value NEKBSH and at the same time the intake pipe absolute pressure PBA is equal to or lower than the lower reference value PBKBSL represents a region in which the execution of the lean-burn control is permitted. The region in which the engine rotational speed NE falls in the above range and at the same time the intake pipe absolute pressure PBA is between the value PBKBSL and the value PBKBSH represents a hysteresis region. Further, the region in which the engine rotational speed NE is lower than the NEKBSL value or higher than the NEKBSH value, or the intake pipe absolute pressure PBA is higher than the PBKBSH value represents a region in which the execution of the lean-burn control is inhibited. This table is set such that the PBKBSL value and the PBKBSH value each assume a smaller value as the engine rotational speed NE is higher. The NEKBSL value and the NEKBSH are each provided with a hysteresis.

Referring back to FIG. 11, the program proceeds from the step S1104 to a step S1105, wherein it is determined whether or not the vehicle speed VSP is lower than a predetermined value VKBSM. This predetermined value VKBSM is provided with a hysteresis. If VSP<VKBSM holds at the step S1105, which means that the vehicle speed is low, the program proceeds to a step S1106, wherein it is determined whether or not the reference value PBKBS(H/L) is higher than a predetermined upper limit value PKBHLMT. If PBKBS(H/L)>PKBHLMT holds at the step S1106, the reference value PBKBS(H/L) is set to the PKBHLMT value at a step S1107, followed by the program proceeding to the step S1108.

If VSP≧VKBSM holds at the step S1105, or if PBKBS (H/L)≦PKBHLMT holds at the step S1106, the program skips over the step S1107 to the step S1108.

Then, at the step S1108, it is determined whether or not the intake pipe absolute pressure PBA is higher than the PBKBS(H/L) value. If PBA>PBKBS(H/L) holds, the engine load flag FPBKBS, which, when set to "1", indicates that the engine is in a high-load condition, is set to "1" at a step S1109, whereas PBA≦PBKBS holds, the engine load flag FPBKBS is set to "0" at a step S1110, followed by the program proceeding to a step S1111.

At the step S1111, it is determined whether or not the air-fuel ratio-enriching flag FMSFBRICH, which is set by the FIG. 16 subroutine, assumes "1". If the flag FMSFBRICH assumes "0" at the step S1111, the program proceeds to a step S1113, wherein it is determined whether or not the engine rotational speed NE is higher than the lower limit value NEKBSL. On the other hand, if the flag FMSFBRICH assumes "1" at the step S1111, it is determined at a step S1112 whether or not the engine rotational speed NE is higher than a predetermined higher reference value NEKBSMF (e.g. 2500 rpm) within the lean-burn control region, which is set to a slightly higher value than the lower limit value NEKBSL (e.g. 1700 rpm). If NE>NEKBSMF holds, the program proceeds to the step S1113.

If NE>NEKBSL holds at the step S1113, the program proceeds to a step S1114, wherein it is determined whether or not the engine rotational speed NE is lower than the upper limit value NEKBSH. If NE<NEKBSH holds at the step S1114, the program proceeds to a step S1115, wherein it is determined whether or not the engine load flag FPBKBS set at the steps S1109 or S1110 assumes "1". The predetermined values compared at the steps S1112, S1113, and S1114 are each provided with a hysteresis.

If the engine load flag FPBKBS assumes "0" at the step S1115, the lean-burn control-permitting flag FKBSMJG is set to "0".

On the other hand, if NE≦NEKBSMF holds at the step S1112, if NE≦NEKBSL holds at the step S1113, if NE≧NEKBSH holds at the step S1114, or if the engine load flag FPBKBS assumes "1" at the step S1115, then the lean-burn control-permitting flag FKBSMJG is set to "1" at a step S1117.

Figure 11:
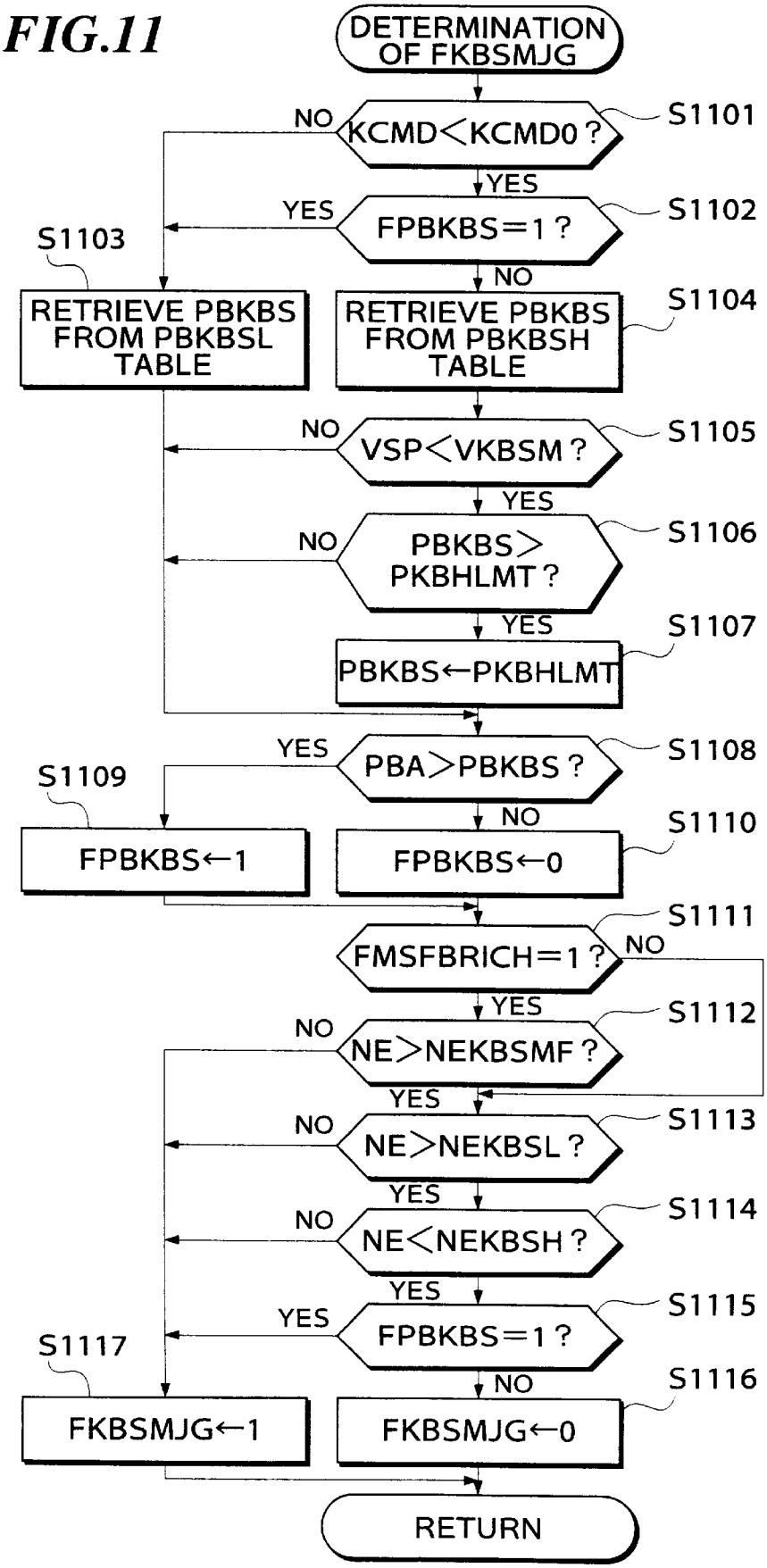
FIG. 11 is a flowchart showing a subroutine for setting a lean-burn control-permitting flag FKBSMJG, which is executed at a step S1002 in FIG. 10.

According to the FIG. 11 subroutine, similarly to the determination executed at the step S1005 in FIG. 10, when the enriching correction amount of the KCMD value to be applied during execution of lean-burn feedback control is larger than the predetermined value (i.e. FMSFBRICH=1 holds) at the step S1111, only if the engine rotational speed NE is higher than the lower reference value NEKBSMF at the step S1112, the execution of the lean-burn feedback control of the air-fuel ratio is permitted. That is, the lean-burn feedback control of the air-fuel ratio is permitted only when the engine is operating in a high rotational speed region where the engine combustion is stable, to thereby prevent Nox from being unnecessarily generated.

Next, a subroutine for carrying out limit-checking of the KCMD value, which is executed at the step S638 in FIG. 7, will be described in detail with reference to FIG. 13.

First, at a step S1310, an actual air-fuel ratio-indicating value DKCMD is calculated as the difference (KCMD(n)−KCMD(n−1) between the present value KCMD(n) and the immediately preceding value KCMD(n−1). The present value KCMD(n) applied for calculating the DKCMD value at the step S1310 is a KCMD value based upon the KBS value calculated by the FIGS. 6 and 7 routine, and is distinguished from KCMD(n) values set based upon the rotational speed variation amount DMSSLB at steps S1605–S1607, S1611 and S1617 in FIG. 16, referred to hereinafter. At the following step S1311, a KCMD correction-executing flag FSLBFB, which, when set to "1", indicates that execution of correction of the KCMD value based on the rotational speed variation amount DMSSLB is permitted, is set by executing a subroutine, described hereinafter with reference to FIG. 15.

Then, at a step S1312, it is determined whether or not the flag FSLBFB assumes "1". If the flag FSLBFB assumes "0" at the step S1312, it is judged that the engine combustion is stable, and then the program proceeds to a step S1322, wherein it is determined whether or not the immediately preceding value KCMD(n−1) of the air-fuel ratio coefficient KCMD is smaller than the predetermined value KCMD0 which is equivalent to the stoichiometric air-fuel ratio. If the answer to the question of the step S1322 is affirmative (YES), i.e. if KCMD(n−1)<KCMD0 holds, which means that the KCMD value is on a leaner side with respect to the stoichiometric air-fuel ratio, the program proceeds to a step S1325, wherein it is determined whether or not the immediately preceding value KCMD(n−1) is larger than a lean-side predetermined value KCMDX (equivalent to an A/F ratio of e.g. 17). If the answer to the question of the step S1325 is affirmative (YES), i.e. if KCMD(n−1)>KCMDX holds, a decreasing variable DKC2, which sets a rate of change in the desired air-fuel ratio in a leaning direction, is set to a first lean-side predetermined decreasing value DKC2L (equivalent to an A/F ratio of e.g. 0.3) at a step S1326, followed by the program proceeding to a step S1328. The decreasing variable DKC2 is applied to an equation for calculating the present value KCMD(n) of the desired air-fuel ratio coefficient KCMD which is executed at a step S1347, referred to hereinafter, to decrease the KCMD value. If the answer to the question of the step S1325 is negative (NO), i.e. if KCMD(n−1)≦KCMDX holds, the decreasing variable DKC2 is set to a second lean-side predetermined decreasing value DKC2M (equivalent of an A/F ratio of e.g. 0.1), which is smaller than the first lean-side predetermined decreasing value DKC2L at a step S1327, followed by the program proceeding to a step S1328.

At the step S1328, it is determined whether or not the engine is idling. If the answer to the question is affirmative (YES), at a step S1332, an increasing variable DKC1, which sets a rate of change in the desired air-fuel ratio in an enriching direction, is set to a predetermined increasing value DKC1IDL (equivalent to an A/F ratio of e.g. 2.0) suitable for idling of the engine, followed by the program proceeding to a step S1343. The increasing variable DKC1 is applied to an equation for calculating the present value KCMD(n) of the KCMD value which is executed at a step S1345, referred to hereinafter, to increase the KCMD value. If the answer to the question of the step S1328 is negative (NO), i.e. if the engine is not idling, it is determined at a step S1329 whether or not the engine rotational speed NE is lower than a predetermined value NKCMD (e.g. 1800 rpm). If the answer to the question is affirmative (YES), the program proceeds to a step S1330, wherein the increasing variable DKC1 is set to a predetermined increasing value DKC1M1H (equivalent to an A/F ratio of e.g. 1.0) suitable for a low rotational speed of the engine, which is smaller than the predetermined increasing value DKC1IDL. On the other hand, if the answer to the question of the step S1329 is negative (NO), at a step S1331, the increasing variable DKC1 is set to a predetermined increasing value DKC1M1L (equivalent to an A/F ratio of e.g. 0.05) suitable for a high rotational speed of the engine, which is smaller than the predetermined increasing value DKC1M1H, followed by the program proceeding to the step S1343.

At the step S1343, it is determined whether or not the amount of change DKCMD of the KCMD value assumes a negative value. If the answer to the question is affirmative (YES), i.e. if the KCMD value has changed in a decreasing direction, it is determined at a step S1346 whether or not the absolute value of the difference DKCMD is smaller than the decreasing variable DKC2. If the answer to the question is negative (NO), i.e. if |DKCMD|≧DKC2 holds, the present value KCMD(n) is changed to a value of (KCMD(n−1)−DKC2), whereas if the answer is affirmative (YES), the program jumps to a step S1348.

If the answer to the question of the step S1343 is negative (NO), i.e. if DKCMD≧0 holds, which means that the KCMD value has changed in an increasing direction, it is determined at a step S1344 whether or not the absolute value of the amount of change DKCMD is smaller than the increasing variable DKC1. If the answer to the question of the step S1344 is negative (NO), i.e. if |DKCMD|≧DKC1 holds, the present value KCMD(n) is changed to a value of (KCMD(n−1)+DKC1) at a step S1345, whereas if the answer is affirmative (YES), the program jumps to the step S1348.

According to the steps S1343 to S1347, when the absolute value of the amount of change DKCMD in the KCMD value is larger than the increasing variable DKC1 or the decreasing variable DKC2, the present value KCMD(n) of the KCMD value is changed to a value calculated by the use of the DKC1 value or the DKC2 value and the immediately preceding value KCMD(n−1) of the KCMD value, thereby preventing the KCMD value from being drastically changed to prevent the driveability of the engine from being sharply degraded.

On the other hand, if the answer to the question of the step S1322 is negative (NO), i.e. if KCMD(n−1)≧KCMD0 holds, which means that the KCMD value is equal to or richer than the predetermined value KCMD0 equivalent to the stoichiometric air-fuel ratio, the decreasing variable DKC2 or the increasing variable DKC1 is set at steps S1333 to S1342, followed by the program proceeding to the step S1343.

First, at the step S1333, it is determined whether or not the WOT flag FWOT assumes "1". If the answer to the question is negative (NO), the increasing variable DKC1 is set to a predetermined increasing value DKC1M2(equivalent to an A/F ratio of e.g. 0.3) suitable for a normal operating condition of the engine at the step S1339, followed by the program proceeding to the step S1342. On the other hand, if the answer to the question of the step S1333 is affirmative (YES), i.e. if the flag FWOT assumes "1", which means that the engine is in a predetermined high-load operating condition, it is determined at the step S1334 whether or not the immediately preceding value KCMD(n−1) is larger than the desired air-fuel ratio coefficient KTWLAF to be applied when the engine coolant temperature is low. If the answer to the question is negative (NO), the program proceeds to the step S1339, whereas if the answer is affirmative (YES), it is determined at a step 1335 whether or not failure or malfunctioning of any device of the system such as a sensor electrically connected to the ECU 5 has been detected. If the answer to the question is affirmative (YES), i.e. if any failure or malfunctioning has been detected, at the step S1340, the increasing variable DKC1 is set to a predetermined increasing value DKC1H (equivalent to an A/F ratio of e.g. 0.8) suitable for a high engine coolant temperature condition of the engine, which is larger than the predetermined increasing value DKC1M2, followed by the program proceeding to the step S1342.

If the answer to the question of the step S1335 is negative (NO), i.e. if no failure or malfunction of the system has been detected, it is determined at the step S1336 whether or not a high engine coolant temperature enriching flag FXWOT, which, when set to "1", indicates that the engine coolant temperature is high in a high-load operating condition of the engine, assumes "1". If the answer to the question is affirmative (YES), the program proceeds to the step S1340, whereas if the answer is negative (NO), it is determined at the step S1337 whether or not the high-speed valve timing is selected. If the answer to the question is negative (NO), i.e. if the low-speed valve timing is selected, it is determined at the step S1338 whether or not a flag FTHWOT, which, when set to "1", indicates that the throttle valve is substantially fully open, assumes "1". If the answer to the question of the step S1337 or S1338 is affirmative (YES), i.e. if the high-speed valve timing is selected, or if the low-speed valve timing is selected and at the same time the throttle valve is substantially fully open, then the program proceeds to the step S1339. If the answers to the questions of the steps S1337 and S1338 are both negative (NO), i.e. if the low-speed valve timing is selected and at the same time the throttle valve is not fully open, the program proceeds to a step S1341, wherein the increasing variable DKC1 is set to a predetermined increasing value DKC1L suitable for a high-load condition of the engine (equivalent to an A/F ratio of e.g. 0.05), which is smaller than the predetermined increasing value DKC1M2 suitable for a normal operating condition of the engine, followed by the program proceeding to the step S1342.

At the step S1342, the decreasing variable DKC2 is set to a rich-side predetermined decreasing value DKC2H (equivalent to an A/F ratio of e.g. 0.4), followed by the program proceeding to the step S1343.

On the other hand, if the flag FSLBFB assumes "1" at the step S1312, the program proceeds to a step S1356, wherein the FIG. 16 subroutine is carried out for correcting the KCMD value based on the rotational speed variation amount DMSSLB, followed by the program proceeding to the step S1348.

At the step S1348 and the following steps S1349, S1350 and S1351, limit-checking of the KCMD value is executed. More specifically, first, at the steps S1348 and S1349, the KCMD value is compared with predetermined upper and lower limit values KCMLMH and KCMLML, respectively. If the KCMD value is larger than the predetermined upper limit value KCMLMH, the KCMD value is set to the value KCMLMH at the step S1351, and if the KCMD value is smaller than the predetermined lower limit value KCMLML, the KCMD value is set to the value KCMLML at the step S1350, in both cases followed by the program proceeding to a step S1352. If the answers to the questions of the step S1348 and S1349 are negative (NO), i.e. if the KCMD value is within a predetermined range defined by the upper and lower limit values KCMLMH, KCMLML, the program proceeds to the step S1352 without changing the KCMD value.

Then, at the step S1352, calculation of an average value DMSBAVE of the rotational speed variation amount DMSSLB is carried out by a subroutine described hereinafter with reference to FIG. 17, followed by terminating the program.

Next, the subroutine for determining the KCMD correction-executing flag FSLBFB, which is executed at the step S1311 in FIG. 13, will be described with reference to FIG. 15.

First, at a step S1501, an unstable combustion-determining coefficient table SLBALPH is retrieved according to the intake pipe absolute pressure PBA to determine an unstable combustion-determining coefficient $\alpha$. The coefficient $\alpha$ is set such that it becomes smaller as the engine load is higher. The coefficient $\alpha$ is a threshold value used by the FIG. 16 subroutine for setting a rate of correction at which the KCMD value is corrected in an enriching direction according to a combustion variation characteristic particular to the engine.

Then, at a step S1502, it is determined whether or not the difference or actual air-fuel ratio-indicating value DKCMD set at the step S1310 in FIG. 13 is positive. If DKCMD>0 holds at the step S1502, which means that the desired air-fuel ratio coefficient KCMD has changed in an enriching direction, a DMSBAVE-updating flag FAVEHLD, which, when set to "1", indicates that updating of the DMSBAVE value is permitted, is set to "0" at a step S1503, and the KCMD correction-executing flag FSLBFB is set to "0" at a step S1504, followed by terminating the program.

If DKCMD≦0 holds at the step S1502, the program proceeds to a step S1505, wherein it is determined whether or not the KCMD correction-executing flag FSLBFB assumes "1". When this step is first carried out, FSLBFB=0 holds, so that it is further determined at a step S1506 whether or not the immediately preceding value KCMD(n−1) of the desired air-fuel ratio coefficient KCMD is smaller than the lean burn-determining reference value KCMDZL.

If KCMD(n−1)≧KCMDZL holds at the step S1506, which means that the lean-burn control is not being carried out, the program proceeds to a step S1503 et seq., whereas if KCMD(n−1)<KCMDZL holds, it is judged that the lean-burn control is being carried out, and it is determined at a step S1507 whether or not the absolute value of the difference DKCMD is larger than an actual lean limit-defining learned value DKCMDX of the DKCMD value calculated at a step S1619 in FIG. 16, referred to hereinafter.

If |DKCMD|≦DKCMDX holds at the step S1507, which means that the desired air-fuel ratio coefficient KCMD(n−1) is close to a lean limit for stable engine combustion, the flag FSLBFB is set to "1" at a step S1508, to start monitoring of the combustion variation, followed by terminating the program. On the other hand, if |DKCMD|>DKCMDX holds at the step S1507, the program proceeds to a step S1509, wherein it is determined whether or not the absolute value of the difference DKCMD is larger than a combustion variation determination-inhibiting threshold value DKCMDX2. This threshold value DKCMDX2, which is set to a value larger than the DKCMDX value, serves as a threshold value for inhibiting correction of the desired air-fuel ratio coefficient KCMD in an enriching direction according to the degree of unstability of the engine combustion at the start of lean-burn feedback control of the air-fuel ratio.

Figure 17:
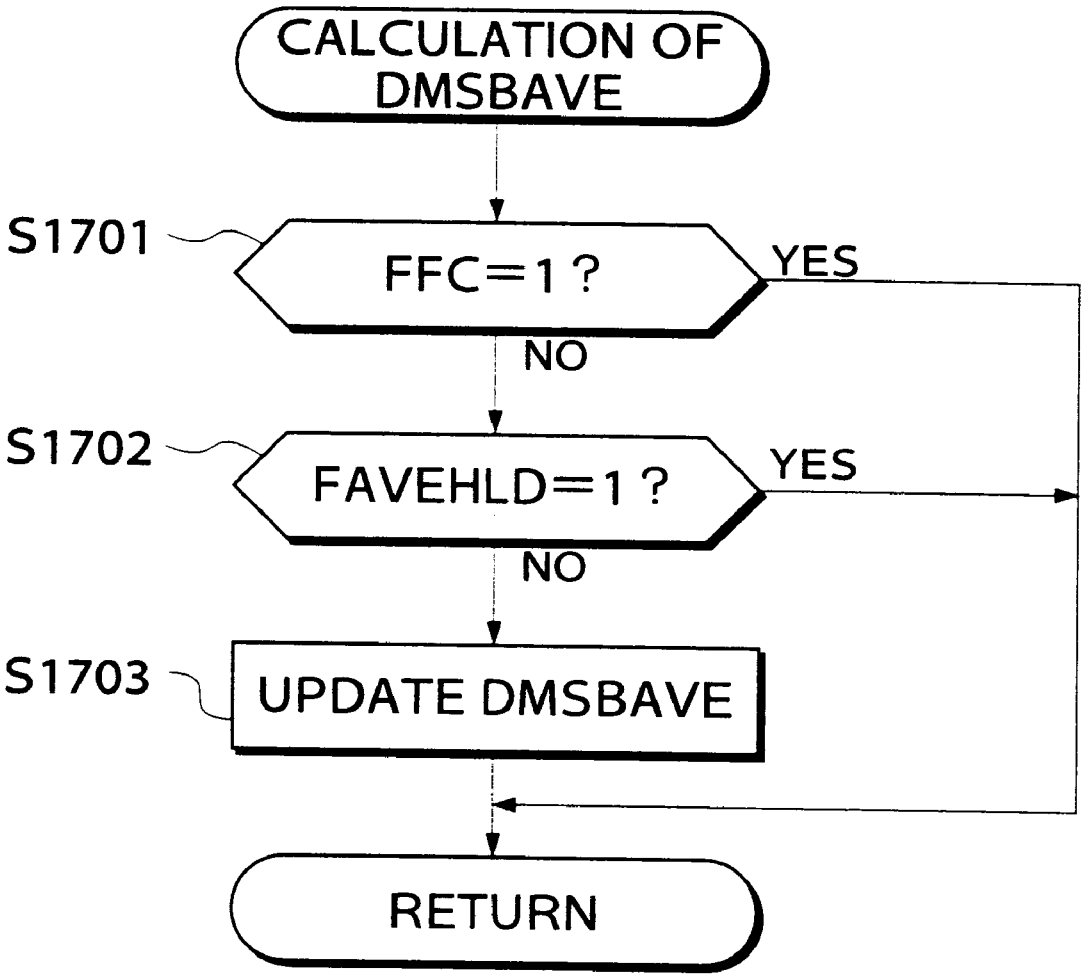
FIG. 17 is a flowchart showing a subroutine for calculating an average value DMSBAVE of the rotational speed variation amount DMSSLB, which is executed at a step S1352 in FIG. 14.

If |DKCMD|>DKCMDX2 holds at the step S1509, the program proceeds to the step S1503, whereas if |DKCMD|≦DKCMDX2 holds, it is further determined at a step S1510 whether or not the rotational speed variation amount DMSSLB is larger than a second unstable combustion-determining upper threshold value α×DMSBAVE for determining unstable combustion of the engine, which is obtained by multiplying the unstable combustion-determining coefficient α by the average value DMSBAVE of the rotational speed variation amount DMSSLB calculated by the subroutine described hereinafter with reference to FIG. 17.

If DMSSLB>α×DMSBAVE holds at the step S1510, it is judged that the engine combustion is unstable, and then the program proceeds to the step S1508, whereas if DMSSLB≦α×DMSBAVE holds, it is further determined at a step S1511 whether or not the DMSSLB value is larger than the first unstable combustion-determining upper threshold value MSLEAN2 for determining unstable combustion of the engine.

If DMSSLB>MSLEAN2 holds at the step S1511, it is judged that the engine combustion is unstable, and then the KMCD correction-executing flag FSLBFB is set to "1" at the step S1508, whereas if DMSSLB≦MSLEAN2 holds, it is judged that the engine combustion is stable, and then the steps S1503 and S1504 are executed, followed by terminating the program.

Figure 15:
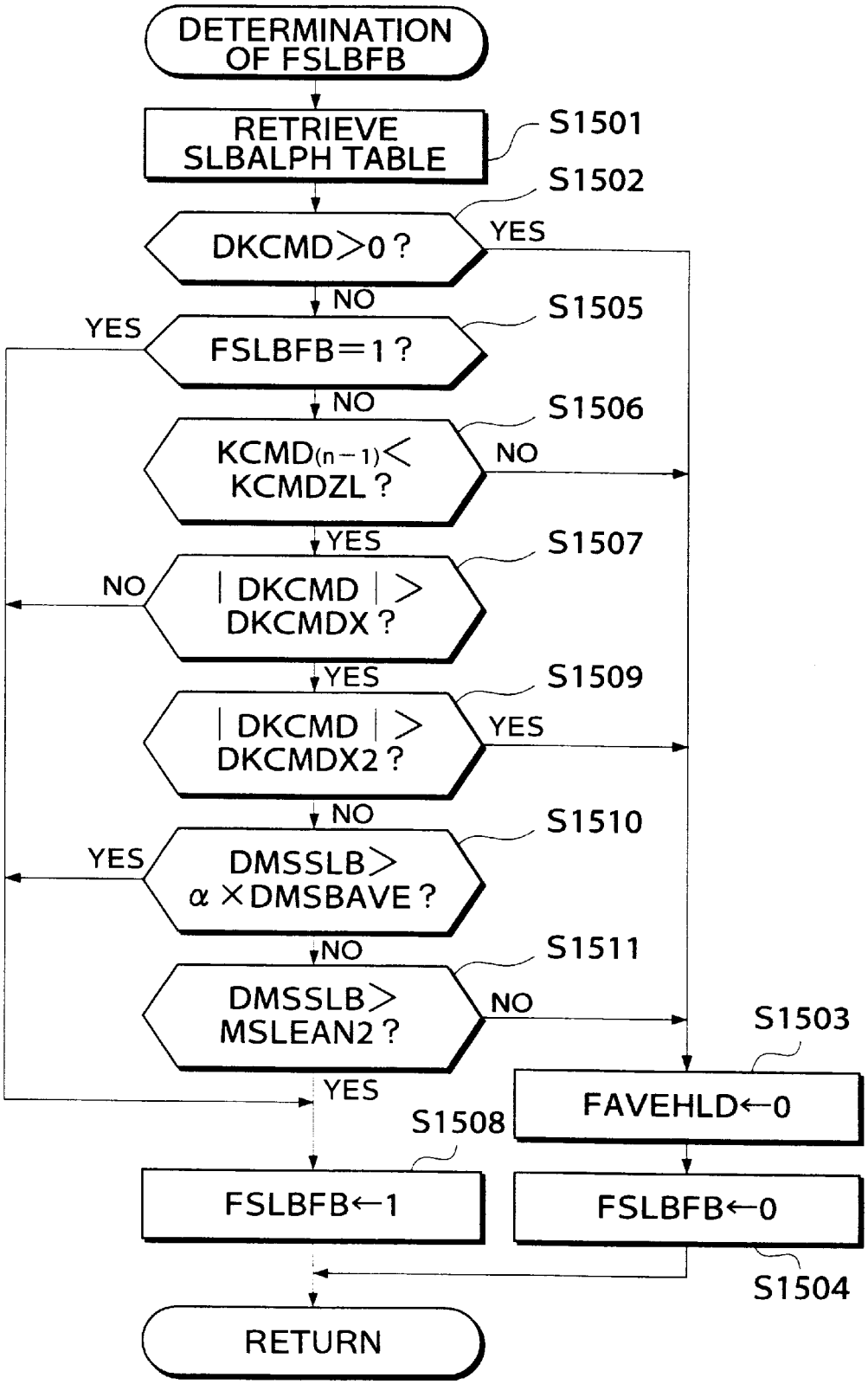
FIG. 15 is a flowchart showing a subroutine for setting a KCMD correction-executing flag FSLBFB, which is executed at a step S1311 in FIG. 13.
Figure 19A:
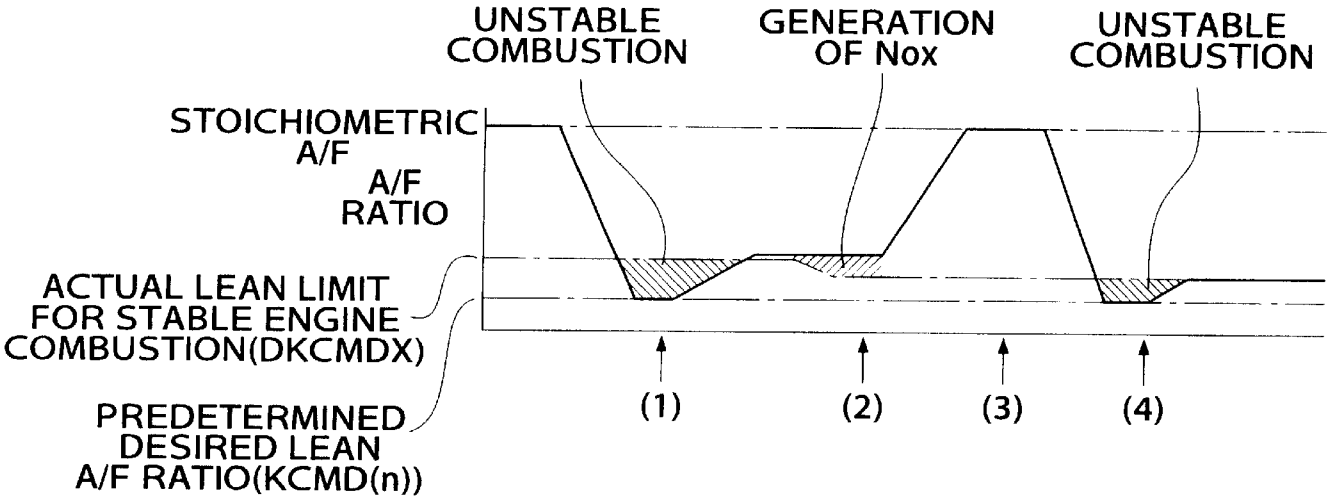
Figure 19B:
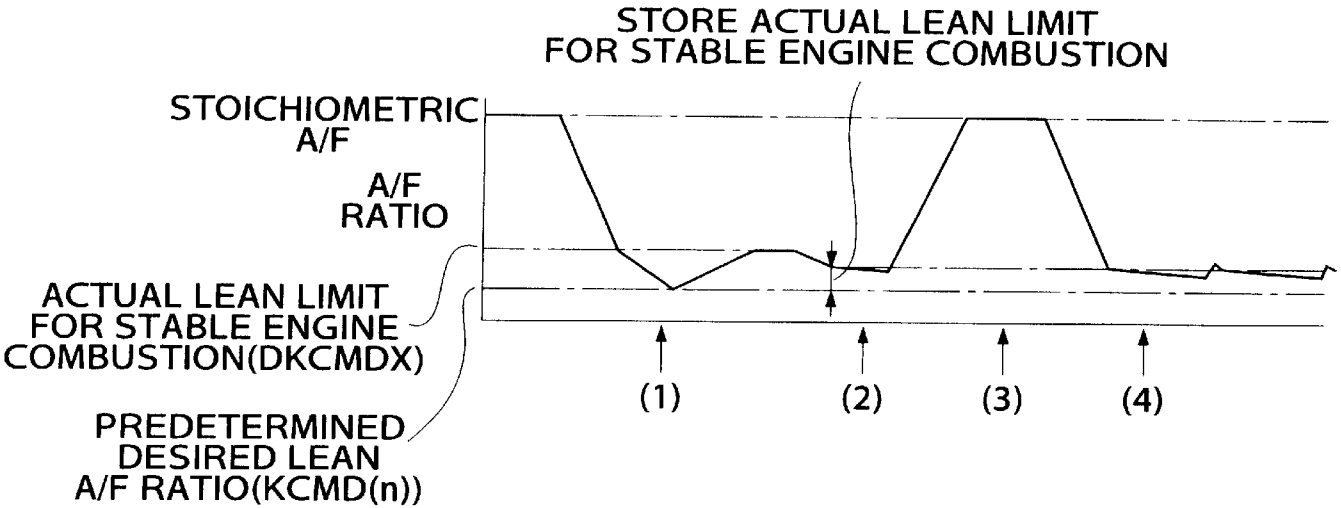

According to the FIG. 15 subroutine described above, as shown in FIG. 18, when the KCMD value has changed to a leaner value than the value DKCMDX2 (i.e. when the answer to the question of the step S1506 in FIG. 15 is negative (NO)), the monitoring of the DMSSLB value is started (steps S1510 and S1511 in FIG. 19). If the DMSSLB value exceeds the value MSLEAN2 or the value α×DMSBAVE, the flag FSLBFB is set to "1" (step S1508), to start correction of the KCDM value. If the absolute value of the DKCMD value is judged to be smaller than the DKCMDX value (step S1507), however, the flag FSLBFB is set to "1" at the step S1508 irrespective of the DMSSLB value.

Further, it is determined at the step S1509 whether or not the absolute value of the difference DKCMD is larger than the reference value DKCMDX2, and if |DKCMD|>DKCMDX2 holds, the KCMD correction-executing flag FSLBFB is set to "0" at the step S1504. Therefore, in this case, correction of the KCMD value in an enriching direction in response to unstability of the engine combustion is inhibited. This prevents the desired air-fuel ratio KCMD from being unnecessarily corrected in an enriching direction in response to a change in the engine torque caused by a change in the air-fuel ratio from the stoichiometric air-fuel ratio to a lean-side desired air-fuel ratio due to an erroneous judgment that the change in the engine torque is caused by unstable combustion, which enables the desired air-fuel ratio to be smoothly changed to the lean-side desired air-fuel ratio.

Next, the subroutine for correcting the KCMD value according to the rotational speed variation amount DMSSLB, which is executed at the step S1356, will be described with reference to FIG. 16. This process is executed in synchronism with generation of each CRK signal pulse.

First, at a step S1601, it is determined whether or not the DMSSLB value is larger than the value MSLEAN2. If DMSSLB>MSLEAN2 holds, it is judged that the engine combustion is unstable, and hence the KCMD value is corrected in an enriching direction. In this case, an enriching correction amount DKCR to be added to the KCMD value is set to a relatively large first correction amount DKCR1 (equivalent to an A/F ratio of e.g. 0.2) at a step S1602. The MSLEAN2 value is a threshold value for determining unstability of the engine combustion, which is set according to operating conditions of the engine, irrespective of differences in characteristics between individual engines employed.

If DMSSLB≦MSLEAN2 holds at the step S1601, it is further determined at a step S1603 whether or not the DMSSLB value is larger than the value α×DMSBAVE. If DMSSLB>α×DMSBAVE holds, the KCMD value is corrected in an enriching direction. In this case, the enriching correction amount DKCR is set to a relatively small second correction amount DKCR2 (equivalent to an A/F ratio of e.g. 0.01), which is smaller than the value DKCR1, at a step S1604. The α×DMSBAVE value is a threshold value for determining unstability of the engine combustion, which is calculated by multiplying the average value DMSBAVE of the rotational speed variation amount detected when the engine combustion is stable by the coefficient α set according to operating conditions of the engine. When it is determined by the use of this threshold value that the engine combustion is unstable, the KCMD value is corrected by the use of the relatively small second correction amount DKCR2, which makes it possible to effect fine adjustment of the coefficient KCMD to an optimal value suitable for improvement of both the driveability and fuel consumption of the engine in dependence on characteristics peculiar to the engine.

At the step S1605, the enriching correction amount DKCR set to the correction amount DKCR1 or DKCR2 as described above is added to the immediately preceding value KCMD(n−1) of the KCMD value to thereby obtain the present value KCMD(n). Then, at the step S1606, it is determined whether or not the KCMD value is larger than the predetermined upper limit value KCMDFBH (equivalent to an A/F ratio of e.g. 19) applied during execution of the lean-burn control.

If KCMD(n)>KCMDFBH holds at the step S1606, the KCMD(n) value is set to the upper limit value KCMDFBH at the step S1607, the air-fuel ratio-enriching flag MSFBRICH is set to "1" at a step S1608, and the DMSBAVE-updating flag FAVEHLD is set to "1" at a step S1609. If KCMD(n)≦KCMDFBH holds at the step S1606, the program jumps to the step S1609.

If DMSSLB≦α×BMSBAVE holds at the step S1603, the program proceeds to a step S1610, wherein it is determined whether or not the DMSSLB value is larger than the lower threshold value MSLEAN1. If DMSSLB>MSLEAN1 holds at the steps S1610, the immediately preceding value KCMD (n−1) is set as it is to the present value KCMD(n) at the step S1611, and the DMSBAVE-updating flag FAVEHLD is set "0" at a step S1612.

If DMSSLB≦MSLEAN1 holds at the step S1610, it is judged that the engine combustion is stable, and then the program proceeds to a step S1613, wherein it is determined whether or not the absolute value of the difference DKCMD is larger than the actual lean limit-defining learned value DKCMDX defining an actual lean limit for stable engine combustion of the KCMD value during execution of the lean-burn control. IF |DKCMD|>DKCMDX holds at the step S1613, a leaning correction amount DKCL is set to a relatively large correction amount DKCL1 (equivalent to an A/F ratio of e.g. 0.01) at a step S1614, whereas if |DKCMD|≦DKCMDX holds, the leaning correction amount DKCL is set to a relatively small correction amount DKCL2 (equivalent to an A/F ratio of e.g. 0.05) at a step S1615.

As described above, the rate of correction of the KCMD value in a leaning direction is changed depending on whether the absolute value of the difference DKCMD is larger than the DKCMDX value, whereby it is possible to avoid excessive correction of the KCMD value in a leaning direction.

After the setting of the leaning correction amount DKCL is completed, it is determined at a step S1616 whether or not the absolute value of the difference DKCMD is smaller than the DKCL value. If |DKCMD|<DKCL holds, the immediately preceding value KCMD(n−1) is set as it is to the present value KCMD(n,) followed by the program proceeding to the step S1612. On the other hand, if |DKCMD|≧DKCL holds, the DKCL value is subtracted from the immediately preceding value KCMD(n−1) to thereby obtain the present value KCMD(n) at the step S1617, followed by the program proceeding to the step S1612.

Then, after the setting of the flag FAVEHLD is effected at the steps S1609 or S1612, it is determined at a step S1618 whether or not the KBSM value retrieved by the FIG. 10 routine is smaller than a threshold value KBSDFCX (e.g. a value equivalent to an A/F ratio of 21.4). If KBSM<KBSDKCX holds, the DKCMDX value is updated by a calculation by the use of the following equation (5) at a step S1619 and the updated DKCMDX value is stored in the memory means 5*c* which is backed up during stoppage of the engine, followed by terminating the program:

$$DKCMDX(n)=c\times|DKCMD|+(1-c)\times DKCMDX(n-1) \quad (5)$$

where c represents a constant set to a value between 0 and 1.0.

If KBSM≧KBSDKCX holds at the step S1618, the program is terminated without carrying out the calculation of the DKCMDX value.

As described above, according to the FIG. 16 subroutine, when the detected rotational speed variation amount DMSSLB is larger than the predetermined threshold value MSLEAN2, which is fixed, the desired air-fuel ratio coefficient KCMD is corrected in an enriching direction by the use of the relatively large correction amount DKCR1, whereas when DMSSLB≦MSLEAN2 and at the same time DMSSLB>α×DMSBAVE holds, the KCMD value is corrected by the use of the relatively small second DKCR2. Therefore, it is possible to effect fine adjustment of the coefficient KCMD to an optimal value at which the driveability and fuel economy of the engine are balanced while accommodating differences in operating characteristics between individual engines employed.

Next, the subroutine for calculating the average value DMSBAVE of the rotational speed variation amount, which is executed at the step S1352 in FIG. 13, will be described with reference to FIG. 17. This process is executed in synchronism with generation of each TDC signal pulse.

First, at a step S1701, it is determined whether or not a fuel cut-determining flag FFC, which, when set to "1", indicates that fuel cut is being carried out, assumes "1". If the flag FFC assumes "1" at the step S1701, it is judged that fuel cut is being carried out, and then the program is immediately terminated without updating the DMSBAVE value. If the flag FFC assumes "0" at the step S1701, the program proceeds to a step S1702, wherein it is determined whether or not the DMSBAVE-updating flag FAVEHLD assumes "1". If the flag FAVEHLD assumes "1" at the step S1702, the program is immediately terminated without updating the DMSBAVE value. If the flag FAVEHLD assumes "0", calculation of the DMSBAVE value for updating the same is carried out by the use of the following equation (6) at a step S1703, followed by terminating the program:

$$DMSBAVE(n)=C\times DMSSLB+(1-c)\times DMSBAVE(n-1) \quad (6)$$

where c represents a constant set to a value between 0 and 1.0.

According to the above described embodiment, at the step S1619 in FIG. 16, the learned value DKCMDX of the difference DKCMD between the desired air-fuel ratio coefficient KCMD value (KCMD(n−1)) corresponding to the actual lean limit for stable engine combustion, which is obtained during the lean-burn control, and the predetermined desired lean air-fuel ratio (KCMD(n) ≈KBS) is calculated and stored, and then, at the steps S1613 to S1617, the rate of change in the controlled air-fuel ratio in a leaning direction during execution of the lean-burn feedback control is set to a larger value when the controlled air-fuel ratio is richer than the actual lean limit for stable engine combustion (the answer to the question of the step S1613 is affirmative (YES)), whereas the same is set to a smaller value when the controlled desired air-fuel ratio is leaner than the actual lean limit for stable engine combustion (the answer to the question of the step S1613 is negative (NO)). As a result, as indicated by (1) and (4) in FIG. 19B, during leaning control of the air-fuel ratio of the mixture to the predetermined desired lean air-fuel ratio, after the controlled air-fuel ratio has reached the actual lean limit, the leaning correction of the air-fuel ratio is carried out by the use of the relatively small correction amount DKCL2 so that the controlled air-fuel ratio is leaned along a gentler curve than before the controlled air-fuel ratio has reached the actual lean limit, thereby preventing the engine combustion from becoming unstable. Further, even when the combustion state of the engine is stable as indicated by (2) in FIG. 19B, one of the relatively large leaning correction amount DKCL2 and the relatively small leaning correction amount DKCL1 is selectively applied for correction of the air-fuel ratio depending on whether the controlled air-fuel ratio is on a leaner side of the actual lean limit or on a richer side of the same (steps S1507 and S1508 in FIG. 15, and steps S1603, S1610, S1613 to S1617), thereby preventing NOx from being generated.

What is claimed is:

1. In an air-fuel ratio control system for an internal combustion engine having an exhaust system, said air-fuel ratio control system including air-fuel ratio-detecting means arranged in said exhaust system for generating an output substantially proportional in value to an air-fuel ratio of exhaust gases emitted from said engine, combustion variation-detecting means for detecting an amount of variation in combustion of said engine, desired air-fuel ratio-setting means for setting a desired air-fuel ratio of a mixture supplied to said engine to a value leaner than a stoichiometric air-fuel ratio based on said amount of variation in combustion of said engine, when said engine is in a predetermined operating condition, and feedback control means for carrying out feedback control of an air-fuel ratio of said mixture to said desired air-fuel ratio in response to said output from said air-fuel ratio-detecting means, the improvement wherein said desired air-fuel ratio-setting means comprises:

combustion variation-responsive means for setting said desired air-fuel ratio to a richer value than an immediately preceding value thereof when said amount of variation in combustion of said engine detected by said combustion variation-detecting means is large, and setting said desired air-fuel ratio to a leaner value than said immediately preceding value thereof, when said amount of variation in combustion of said engine detected by said combustion variation-detecting means is small;

learning means for learning a value of said desired air-fuel ratio set by said combustion variation-responsive means as an actual lean limit of said air-fuel ratio for stable combustion of said engine; and desired air-fuel ratio-adjusting means for adjusting a rate of change of said desired air-fuel ratio based on said learned value of said desired air-fuel ratio obtained by said learning means.

2. An air-fuel ratio control system according to claim 1, wherein said combustion variation-responsive means changes said desired air-fuel ratio to said richer value than said immediately preceding value when said amount of variation in combustion of said engine is larger than a first predetermined value, and changes said desired air-fuel ratio to said leaner value than said immediately preceding value when said amount of variation in combustion of said engine is smaller than a second predetermined value which is smaller than said first predetermined value.

3. An air-fuel ratio control system according to claim 2, wherein said desired air-fuel ratio-adjusting means sets said rate of change of said desired air-fuel ratio to a lower rate when said desired air-fuel ratio is leaner than said learned value of said desired air-fuel ratio than when said desired air-fuel ratio is richer than said learned value of said desired air-fuel ratio.

4. An air-fuel ratio control system according to claim 1, including storing means for permanently storing said learned value of said desired air-fuel ratio obtained by said learning means.

5. In an air-fuel ratio control system for an internal combustion engine having an exhaust system, said air-fuel ratio control system including air-fuel ratio-detecting means arranged in said exhaust system for generating an output substantially proportional in value to an air-fuel ratio of exhaust gases emitted from said engine, combustion variation-detecting means for detecting an amount of variation in combustion of said engine, desired air-fuel ratio-setting means for setting a desired air-fuel ratio of a mixture supplied to said engine to a value leaner than a stoichiometric air-fuel ratio based on said amount of variation in combustion of said engine, when said engine is in a predetermined operating condition, and feedback control means for carrying out feedback control of an air-fuel ratio of said mixture to said desired air-fuel ratio in response to said output from said air-fuel ratio-detecting means, the improvement wherein said desired air-fuel ratio-setting means comprises combustion variation-responsive means for setting said desired air-fuel ratio to a richer value than an immediately preceding value thereof when said amount of variation in combustion of said engine detected by said combustion variation-detecting means is large; and wherein said air-fuel ratio control system comprises lean-burn condition-limiting means for permitting said desired air-fuel ratio-setting means to set said desired air-fuel ratio to said value leaner than said stoichiometric air-fuel ratio only when said engine is in an operating condition more limited than said predetermined operating condition, after said richer value of said desired air-fuel ratio than said immediately preceding value set by said combustion variation-responsive means has reached a predetermined value.

6. An air-fuel ratio control system according to claim 5, wherein said engine is installed on an automotive vehicle having a transmission, said air-fuel ratio control system including gear position-determining means for determining a gear position of said transmission which is selected, said lean-burn condition-limiting means permitting said desired air-fuel ratio-setting means to set said desired air-fuel ratio to said value leaner than said stoichiometric air-fuel ratio only when said gear position of said transmission determined by said gear position-determining means is within a gear position range limited to higher speed positions than a gear position range set for said predetermined operating condition of said engine, after said richer value of said desired air-fuel ratio than said immediately preceding value set by said combustion variation-responsive means has reached said predetermined value.

7. An air-fuel ratio control system according to claim 5, including rotational speed-detecting means for detecting rotational speed of said engine, and wherein said lean-burn condition-limiting means permits said desired air-fuel ratio-setting means to set said desired air-fuel ratio to said value leaner than said stoichiometric air-fuel ratio only when said rotational speed of said engine detected by said rotational speed-detecting means is within a rotational speed range limited to higher rotational speeds than a rotational speed range set for said predetermined operating condition of said engine, after said richer value of said desired air-fuel ratio than said immediately preceding value set by said combustion variation-responsive means has reached said predetermined value.

8. In an air-fuel ratio control system for an internal combustion engine having an exhaust system, said air-fuel ratio control system including air-fuel ratio-detecting means arranged in said exhaust system for generating an output substantially proportional in value to an air-fuel ratio of exhaust gases emitted from said engine, combustion variation-detecting means for detecting an amount of variation in combustion of said engine, desired air-fuel ratio-setting means for setting a desired air-fuel ratio of a mixture supplied to said engine to a value leaner than a stoichiometric air-fuel ratio based on said amount of variation in combustion of said engine, when said engine is in a predetermined operating condition, and feedback control means for carrying out feedback control of an air-fuel ratio of said mixture to said desired air-fuel ratio in response to said output from said air-fuel ratio-detecting means, the improvement wherein said desired air-fuel ratio-setting means comprises combustion variation-responsive means for setting said desired air-fuel ratio to a richer value than an immediately preceding value thereof when said amount of variation in combustion of said engine detected by said combustion variation-detecting means is large; and wherein said air-fuel ratio control system comprises limiting means for limiting said desired air-fuel ratio to a predetermined value when said richer value of said desired air-fuel ratio than said immediately preceding value set by said combustion variation-responsive means has reached said predetermined value.

9. In an air-fuel ratio control system for an internal combustion engine having an exhaust system, said air-fuel ratio control system including air-fuel ratio-detecting means arranged in said exhaust system for generating an output substantially proportional in value to an air-fuel ratio of exhaust gases emitted from said engine, combustion variation-detecting means for detecting an amount of variation in combustion of said engine, desired air-fuel ratio-setting means for setting a desired air-fuel ratio of a mixture supplied to said engine to a value leaner than a stoichiometric air-fuel ratio, when said engine is in a predetermined operating condition, and feedback control means for carrying out feedback control of an air-fuel ratio of said mixture to said desired air-fuel ratio in response to said output from said air-fuel ratio-detecting means, the improvement comprising:

combustion variation-responsive means for setting said desired air-fuel ratio to a richer value than an immediately preceding value thereof when said amount of variation in combustion of said engine detected by said combustion variation-detecting means is large;

progressively leaning means for progressively changing said desired air-fuel ratio to said value of said desired air-fuel ratio leaner than said stoichiometric air fuel ratio when said desired air-fuel ratio-setting means set said desired air-fuel ratio to said value leaner than said stoichiometric air-fuel ratio; and inhibiting means for inhibiting said combustion variation-responsive means from setting said desired air-fuel ratio to said value richer than said immediately preceding value thereof based on an output from said combustion variation-detecting means until a value to which said desired air-fuel ratio is changed by said progressively leaning means has becomes leaner than a predetermined lean value leaner than said stoichiometric air-fuel ratio.

10. An air-fuel ratio control system according to claim 9, wherein said inhibiting means determines that said value to which said desired air-fuel ratio is changed by said progressively leaning means has become leaner than said predetermined lean value leaner than said stoichiometric air-fuel ratio when a difference between said value of said desired air-fuel ratio set by said desired air-fuel ratio-setting means when said engine is in said predetermined operating condition and said value to which said desired air-fuel ratio is changed by said progressively leaning means becomes smaller than a predetermined amount.

11. An air-fuel ratio control system according to claim 10, wherein said predetermined amount is larger than a difference between said value of said desired air-fuel ratio set by said desired air-fuel ratio-setting means and a value of said air-fuel ratio corresponding to an actual lean limit of said air-fuel ratio for stable combustion of said engine.

12. An air-fuel ratio control system for an internal combustion engine having an exhaust system, said air-fuel ratio control system comprising:

air-fuel ratio-detecting means arranged in said exhaust system for generating an output substantially proportional in value to an air-fuel ratio of exhaust gases emitted from said engine;

combustion variation-detecting means for detecting an amount of variation in combustion of said engine;

desired air-fuel ratio setting means for setting a desired air-fuel ratio of a mixture supplied to said engine to a value leaner than a stoichiometric air-fuel ratio based on said amount of variation in combustion of said engine, when said engine is in a predetermined operating condition;

feedback control means for carrying out feedback control of an air-fuel ratio of said mixture to said desired air-fuel ratio in response to said output from said air-fuel ratio-detecting means;

combustion variation-averaging means for averaging said amount of variation in combustion of said engine detected by said combustion variation-detecting means;

unstable combustion-determining threshold value-setting means for setting a threshold value for determining unstable combustion of said engine, based on an averaged value of said amount of variation in combustion of said engine obtained by said combustion variation-averaging means; and combustion variation-responsive means for setting said desired air-fuel ratio to a richer value than an immediately preceding value thereof when said amount of variation in combustion of said engine detected by said combustion variation-detecting means is larger than said threshold value set by said unstable combustion-determining threshold value-setting means.

13. An air-fuel ratio control system according to claim 12, wherein said unstable combustion-determining threshold value-setting means sets said threshold value for determining said unstable combustion of said engine by multiplying said averaged value of said amount of variation in combustion of said engine by a coefficient dependent on operating conditions of said engine.

14. An air-fuel ratio control system according to claim 12, wherein said combustion variation-responsive means adjusts said desired air-fuel ratio to said value richer than said immediately preceding value by said desired air-fuel ratio-setting means by the use of a first enriching adjusting amount when said amount of variation in combustion detected by said combustion variation-detecting means is larger than a predetermined value which is larger than said threshold value set by said unstable combustion-determining threshold value-setting means, and by the use of a second enriching adjusting amount which is smaller than said first enriching adjusting amount when said amount of variation in combustion of said engine detected by said combustion variation-detecting means is smaller than said predetermined value and at the same time larger than said threshold value.

* * * * *